US007441774B2

(12) United States Patent
Fujii et al.

(10) Patent No.: US 7,441,774 B2
(45) Date of Patent: Oct. 28, 2008

(54) SHEET CONVEYING APPARATUS

(75) Inventors: Takayuki Fujii, Tokyo (JP); Tsuyoshi Moriyama, Ibaraki (JP)

(73) Assignee: Canon Kabushiki Kaisha (JP)

( * ) Notice: Subject to any disclaimer, the term of this patent is extended or adjusted under 35 U.S.C. 154(b) by 42 days.

(21) Appl. No.: 11/552,504

(22) Filed: Oct. 24, 2006

(65) Prior Publication Data

US 2007/0045947 A1 Mar. 1, 2007

Related U.S. Application Data

(63) Continuation of application No. 11/200,018, filed on Aug. 10, 2005, now Pat. No. 7,140,611, which is a continuation of application No. 10/437,734, filed on May 14, 2003, now Pat. No. 7,017,903.

(30) Foreign Application Priority Data

May 14, 2002 (JP) ..... 2002-138433

(51) Int. Cl.
*B65H 39/10* (2006.01)

(52) U.S. Cl. ..... 271/298; 271/3.03; 270/58.09

(58) Field of Classification Search ..... 271/176, 271/262, 263, 298, 279, 288, 290, 292, 297, 271/3.03

See application file for complete search history.

(56) References Cited

U.S. PATENT DOCUMENTS

| | | | |
|---|---|---|---|
| 4,030,607 | A | 6/1977 | Suda et al. |
| 4,166,030 | A | 8/1979 | Lewis et al. |
| 4,757,356 | A | 7/1988 | Garofalo |
| 5,192,261 | A | 3/1993 | Honjo et al. |
| 5,503,382 | A | 4/1996 | Hansen et al. |
| 5,586,755 | A | 12/1996 | Hansen |
| 5,617,956 | A | 4/1997 | Werner et al. |
| 5,625,860 | A | 4/1997 | Maeda et al. |
| 5,626,077 | A | 5/1997 | Muller |
| 5,720,479 | A | 2/1998 | Yamaguchi et al. |
| 5,769,407 | A | 6/1998 | Hansen |
| 5,799,936 | A | 9/1998 | Sekine et al. |
| 5,806,843 | A | 9/1998 | Hansen et al. |
| 5,853,089 | A | 12/1998 | Milne |
| 6,050,561 | A | 4/2000 | Kidokoro et al. |
| 6,082,732 | A | 7/2000 | Hutchinson et al. |
| 6,224,053 | B1 | 5/2001 | Bischke et al. |
| 6,631,896 | B2 | 10/2003 | Yamada et al. |
| 6,892,872 | B2 | 5/2005 | Miyashita |

FOREIGN PATENT DOCUMENTS

| | | | |
|---|---|---|---|
| GB | 2 093 809 | A | 9/1982 |
| JP | 60-180894 | A | 9/1985 |
| JP | 60-191932 | A | 9/1985 |
| JP | 60-204564 | A | 10/1985 |
| JP | 05-178515 | A | 7/1993 |

*Primary Examiner*—Kaitlin S Joerger
(74) *Attorney, Agent, or Firm*—Rossi, Kimms & McDowell, LLP

(57) ABSTRACT

There is provided a sheet conveying apparatus which is capable of easily distinguishing between a sheet bundle containing abnormal sheets, such as multi-fed sheets, and a normal sheet bundle. When it is determined that there is no abnormality in the conveyance of sheets to a processing tray (630), a finisher control section (501) causes a bundle of sheets stacked on the processing tray (630) to be discharged onto a stack tray (700), whereas when it is determined that there is abnormality in the conveyance of sheets to the processing tray (630), the finisher control section (501) causes the bundle of the sheets stacked on the processing tray (630) to be discharged onto a sample tray (701).

5 Claims, 17 Drawing Sheets

SHEET CONVEYING APPARATUS

This is a continuation of U.S. application Ser. No. 11/200,018 filed 10 Aug. 2005, which is a continuation of U.S. application Ser. No. 10/437,734 filed 14 May 2003, now U.S. Pat. No. 7,017,903.

BACKGROUND OF THE INVENTION

1. Field of the Invention

This invention relates to a sheet conveying apparatus, and more particularly to a sheet conveying apparatus that stacks sheets being conveyed on a stacking section and then discharges a bundle of the sheets stacked on the stacking section.

2. Description of the Related Art

Conventional image forming apparatuses such as a copying machine include a type that is capable of operating in a cover mode, an interleaved sheet mode, and the like, in which insert sheets, such as covers, are added to sheets having images formed thereon. In these modes, the image forming apparatus is controlled such that a sheet supplied from a cassette or a feed tray provided in the image forming apparatus can be inserted into a sheet bundle as the first page, the final page, or an intermediate page. The term "insert a sheet" is intended to also mean "add a sheet to" in the case of the sheet being a cover or a back cover, throughout the specification. Therefore, it is possible to carry out processing for forming a sheet bundle out of sheets fed from a single feed cassette and another type of sheets inserted into the sheets from the single feed cassette. More specifically, it is possible to feed inserting sheets (hereinafter referred to as "insert sheets") such as a "cover", an "interleaved sheet" and a "back cover", from other feed cassettes and insert the insert sheets into sheets having images formed thereon, to thereby form a sheet bundle. Further, similar inserting processing can be performed by feeding insert sheets from a special tray having insert sheets stacked thereon.

In this case, the processing relating to insert sheets is a mere sheet conveying operation, and therefore it is possible to freely set both inserting positions of insert sheets in a sheet bundle, i.e. inserting places where insert sheets are to be inserted, and the number of insert sheets to be inserted at each inserting position, as desired. Further, the sheet bundle having the insert sheets inserted therein can be subjected to sheet bundle processing by a finisher or the like which is incorporated in the image forming apparatus, i.e. post-processing including bundle discharge processing for discharging the sheet bundle, staple processing for stapling the sheet bundle, folding processing for folding the sheet bundle, and bookbinding processing for bookbinding the sheet bundle. Hereinafter, operation modes for inserting an insert sheet as a "cover", an "interleaved sheet" or a "back cover", from an insert sheet cassette will be generically referred to as "the interleaved sheet mode".

To supply insert sheets from a cassette, in timing in which an insert sheet is to be inserted, the insert sheet is fed from the cassette to the same conveying path along which a sheet on which an image is to be formed is conveyed, and then the supplied insert sheet is discharged via the conveying path. In an intermediate portion of the conveying path, there is arranged a fixing section, and the insert sheet passes this section as a sheet on which an image is to be formed does.

When a color image-printed original is used as an insert sheet, the insert sheet receives thermal pressure as it passes the fixing section, which can degrade the quality of the printed image. Further, with recent diffusion of personal computers, more and more color images have come to be used, and color copy sheets/color print sheets have come to be used as insert sheets more frequently. However, color copy sheets supplied from a cassette can have oil or the like adhering to surfaces thereof, to deteriorate the sheet conveying performance of the sheet feed mechanism, which can considerably degrade reliability of sheet conveying operation of the apparatus.

Another type of image forming apparatus has emerged in which an insert sheet feeder for supplying insert sheets is provided in a finisher so as to supply insert sheets from the finisher. Apparatuses of this type have been proposed e.g. in Japanese Laid-Open Patent Publications (Kokai) No. 60-180894, No. 60-191932, and No. 60-204564. More specifically, according to the apparatuses disclosed in these patent publications, insert sheets are each supplied from the insert sheet feeder to the finisher in desired timing, and then conveyed to an intermediate tray within the finisher to be received and stacked on the intermediate tray. Sheets discharged from the main unit of the image forming apparatus are also introduced into the finisher to be received and stacked on the intermediate tray. To enable the apparatus to perform such operation, it is necessary to stack in advance insert sheets in a sheet container of the insert sheet feeder in the order corresponding to the order of pages dependent on the contents images to be formed and in a number of sets corresponding to the number of copies to be produced.

However, the above prior art suffers from the following problems. In the conventional image forming apparatus, to insert sheets using the insert sheet feeder in the interleaved sheet mode, it is necessary to reliably feed the insert sheets one by one from the feeder into the finisher. However, the insert sheets include a wide variety of types and usually have a variety of images formed thereon, thus differing in stability from transfer sheets used for having images formed thereon, in performing automatic operation for separating and conveying each sheet. For example, insert sheets can cause so-called "multiple feed" in which a plurality of insert sheets which should be fed one by one are fed simultaneously. This "multiple feed" makes the disorder of the sequence of pages of sheets of the present and following bundles.

Another conventional image forming apparatus has been proposed in which a desired number of copies is set through the operation of an operating section, and the formation of images is continuously carried out until the output of the copies is completed. In this apparatus, when multiple feed of insert sheets occurs, sheet bundles formed after the occurrence of the multiple feed all have insert sheets inserted in wrong places, which causes waste of sheets, time, power consumption, and so forth that are required for outputting the sheet bundles.

Further, still another type of image forming apparatus has been proposed which temporarily stops outputting whenever each sheet bundle is completely output, to thereby enable the user to check whether or not proper output has been performed. In this case, it is possible to detect multiple feed earlier than when the formation of images is continued without stopping any output after multiple feed has occurred. However, e.g. in the case of an output bundle of a large number of sheets, even if the user visually detects multiple feed, since the operation is continued until the output is temporarily stopped, wasteful feed of insert sheets inevitably occurs.

SUMMARY OF THE INVENTION

It is an object of the present invention to provide a sheet conveying apparatus which is capable of easily distinguishing between a sheet bundle containing abnormal sheets, such as multi-fed sheets, and a normal sheet bundle.

To attain the above object, the present invention provides a sheet conveying apparatus comprising a conveyor device that conveys sheets, a stacking device in which the sheets conveyed by the conveyor device are stacked, a discharge device that discharges a bundle of the sheets stacked in the stacking device, a first receiving device that receives a bundle of the sheets discharged by the discharge device, a second receiving device that receives a bundle of the sheets discharged by the discharge device, a determining device that determines whether there is abnormality in conveyance of sheets to the stacking device, and a controller that causes the bundle of the sheets stacked in the stacking device to be discharged onto the first receiving device, in a case where the determining device determines that there is no abnormality in the conveyance of sheets to the stacking device, and causes the bundle of the sheets stacked in the stacking device to be discharged onto the second receiving device in a case where the determining device determines that there is abnormality in the conveyance of sheets to the stacking device.

With the arrangement of the sheet conveying apparatus according to the present invention, even if multiple feed of sheets occurs, it is possible to stack a normally prepared sheet bundle and a sheet bundle which was not normally prepared due to the multiple feed, separately onto respective receiving devices completely apart from each other. This is very advantageous when the sheets include insert sheets which are more likely to be multi-fed than ordinary printing sheets to have images including characters formed thereon, and facilitates recognition of multi-fed insert sheets. Further, this recognition of multi-fed insert sheets makes it possible to reuse the expensive insert sheets made undesired due to the multiple feed.

Preferably, the determining device comprises a detector that detects whether sheets are being conveyed by the conveyor while overlapping each other, and the determining device determines, based on a result of the detection by the detector, whether there is abnormality in the conveyance of sheets to the stacking device.

More preferably, the detector detects thickness of sheets being conveyed in the conveyor device, to thereby detect whether sheets are being conveyed while overlapping each other.

Preferably, the first receiving device and second receiving device are movable, and the controller causes the bundle of the sheets stacked in the stacking device to be discharged onto the first receiving device, by causing the first receiving device to be moved to a position where the first receiving device can receive the bundle of the sheets discharged from the discharge device, and the controller causes the bundle of the sheets stacked in the stacking device to be discharged onto the second receiving device, by causing the second receiving device to be moved to a position where the second receiving device can receive the bundle of the sheets discharged from the discharge device.

Preferably, the sheet conveying apparatus further comprises a second stacking device in which sheets to be fed to the stacking device are stacked, and a feeder that feeds the sheets stacked in the second stacking device, and the conveyor device conveys the sheets fed by the feeder to the stacking device.

More preferably, the sheet conveying apparatus further comprises an image forming device that forms an image on a sheet, and the conveyor device conveys the sheet received from the image forming device to the stacking device.

Further preferably, the sheet conveying apparatus further comprises an input device for inputting settings indicative of which pages of a bundle of sheets to be stacked on the stacking device respective sheets stacked on the second stacking device being to be inserted in, and the controller controls image forming operation of the image forming device and sheet feeding operation of the feeder, based on the settings input by the input device.

Still more preferably, the controller causes all remaining sheets stacked on the second stacking device for the bundle of sheets stacked on the stacking device to be discharged onto the second receiving device when the determining device determines that there is abnormality in the conveyance of sheets to the stacking device.

With the more preferable form of the sheet conveying apparatus, even when multiple feed e.g. of insert sheets occurs, proper recovery processing is automatically executed, so that the user need not carry out the recovery processing, which greatly enhances usability.

More preferably, the controller causes sheets, of which the conveyance is determined to be abnormal, to be discharged to the second receiving device via the stacking device.

More preferably, the controller causes sheets, of which the conveyance is determined to be abnormal, to be discharged directly to the second receiving device.

The above and other objects, features, and advantages of the present invention will become more apparent from the following detailed description taken in conjunction with the accompanying drawings.

BRIEF DESCRIPTION OF THE DRAWINGS

FIGS. 5A to 5C are diagrams useful in explaining examples of screens displayed in an operating section of the image forming apparatus shown in FIG. 1, in which:

FIG. 5A shows a menu option-selecting screen;

FIG. 5B shows a setup screen; and

FIG. 5C shows another setup screen;

FIGS. 6A and 6B are diagrams useful in explaining the flow of sheets in the image forming apparatus shown in FIG. 1 from an inserter 900 and a printer 300 to a processing tray 630 within the finisher 500 in a sort mode, in which:

FIG. 6A shows a stapling side of a sheet and a conveying direction; and

FIG. 6B shows the arrangement of the finisher;

FIGS. 12A to 12D are diagrams useful in explaining a process of image formation in a bookbinding mode of the image forming apparatus shown in FIG. 1, in which:

FIG. 12A shows a set of image data of originals;

FIG. 12B shows pieces of image data formed on faces of sheets;

FIG. 12C shows a conveying direction of the sheets; and

FIG. 12D shows respective received states of the sheets;

FIGS. 16A and 16B are diagrams useful in explaining operations performed by the finisher of the image forming apparatus shown in FIG. 1 when multiple feed has occurred, in which:

FIG. 16A shows a state of the finisher in which multi-fed sheets and undesired insert sheets are discharged onto a processing tray; and FIG. 16B shows a state of the finisher in which a stack tray and a sample tray are lifted;

FIGS. 17A to 17C are diagrams useful in explaining operations performed by a finisher of an image forming apparatus according to a second embodiment of the present invention when multiple feed has occurred, in which:

FIG. 17A shows a state of the finisher in which a stack tray and a sample are lowered;

FIG. 17B shows a state of the finisher in which multi-fed sheets and undesired insert sheets are discharged onto the sample tray; and FIG. 17C shows a state of the finisher in which the stack tray and the sample tray are lifted.

DETAILED DESCRIPTION OF THE PREFERRED EMBODIMENTS

The present invention will now be described in detail with reference to the accompanying drawings showing preferred embodiments thereof.

First, a description will be given of the outline of the present invention before a detailed description of preferred embodiments thereof.

The present invention provides an image forming apparatus equipped with a finisher, wherein if a sheet bundle being prepared exists on a processing tray when multiple feed of insert sheets occurs, the sheet bundle is controlled to be discharged onto a tray (sample tray) different from a stack tray on which a normally-prepared sheet bundle is stacked. In short, even when multiple feed of insert sheets occurs, the image forming apparatus and the finisher are properly controlled to recover the operation of the system from the error of multiple feed without stopping the system operation. Thus, the image forming apparatus according to the present invention has improved usability. It should be noted that a recording sheet and an insert sheet handled by the image forming apparatus according to the present invention may be ordinary paper sheets or other media including OHP media.

Figure 1:
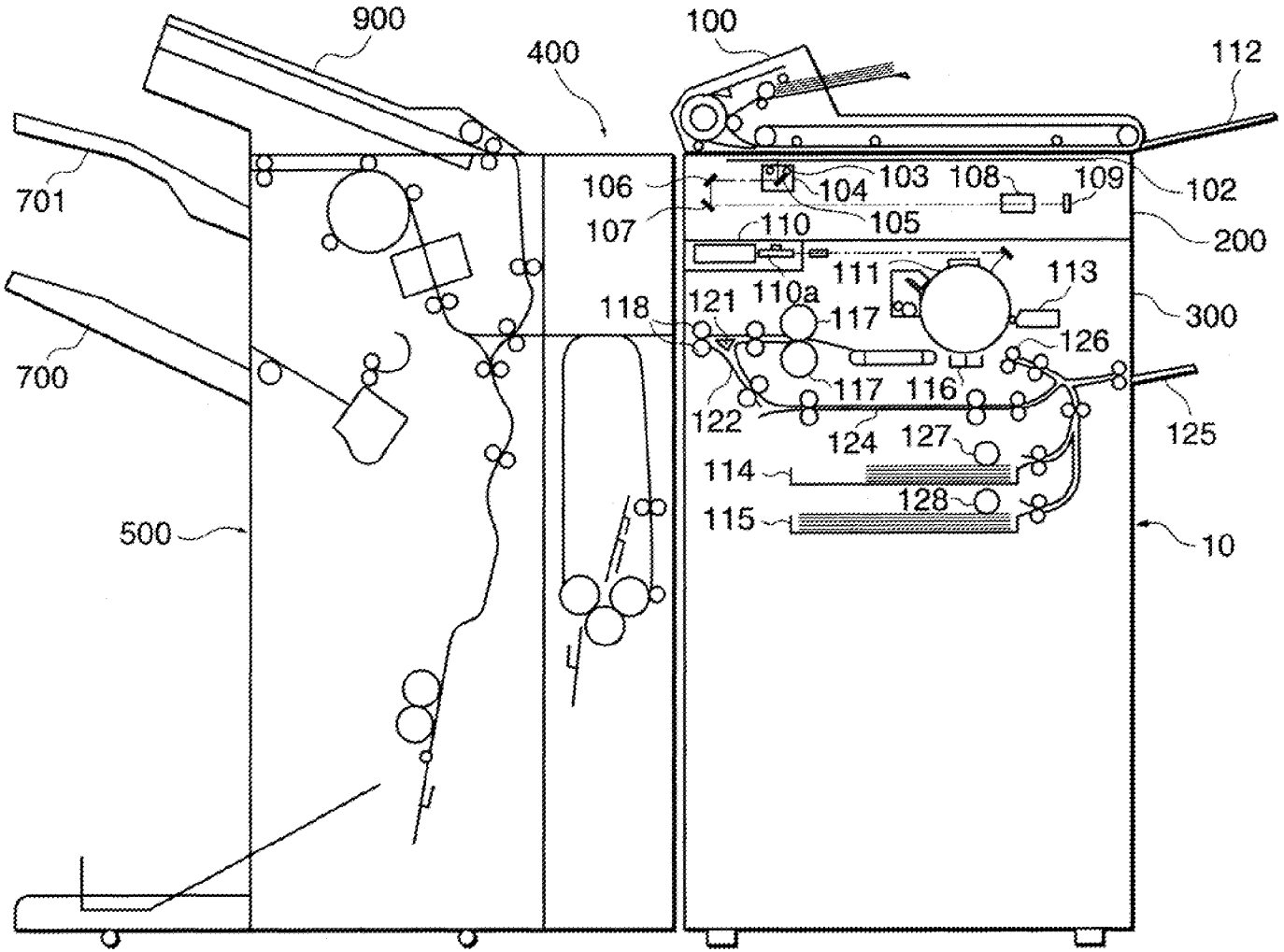
FIG. 1 is a diagram schematically showing a longitudinal cross section of essential parts of an image forming apparatus according to a first embodiment of the present invention.

FIG. 1 is a diagram showing a longitudinal cross section of essential parts of an image forming apparatus according to a first embodiment of the present invention. As shown in FIG. 1, the image forming apparatus according to the present embodiment is comprised of an image forming apparatus main unit 10, a folder 400, and a finisher 500. The image forming apparatus main unit 10 is comprised of an image reader 200 that reads an image from an original and a printer 300 that forms the image on a sheet.

The image reader 200 of the image forming apparatus main unit 10 is equipped with an original feeder 100. The original feeder 100 sequentially feeds originals set on an original tray with their front surfaces facing upward, one by one from the leading page in a leftward direction as viewed in FIG. 1, such that the originals are guided along a curved path and conveyed from the left onto a platen glass 102 and then through a moving original reading position to the right, followed by being discharged to an exterior discharge tray 112. As the original is passing the moving original reading position on the platen glass 102 from left to right, an image of the original is continuously read by a scanner unit 104 held in a position corresponding to the moving original reading position. This reading method is generally called the moving original reading method. More specifically, as an original is passing the moving original reading position, a surface of the original to be scanned is irradiated with light from a lamp 103 of the scanner unit 104, and reflected light from the original is guided to a lens 108 via mirrors 105, 106, 107. The light having passed through the lens 108 forms an image on an imaging surface of an image sensor 109.

Each original is thus conveyed so as to pass the moving original reading position from left to right, whereby scanning is performed to read the original with a direction orthogonal to the conveying direction of the original as the main scanning direction and the conveying direction of the original as the sub scanning direction. More specifically, as the original is passing the moving original reading position, the image of the original is read line by line in the main scanning direction by the image sensor 109 while the original is being fed in the sub scanning direction, whereby the whole original image is read. The image optically read by the image sensor 109 is converted to image data for output. The image data output from the image sensor 109 is subjected to predetermined processing by an image signal control section 202, described in detail hereinafter, and then discharged as a video signal to an exposure control section 110 of the printer 300.

Alternatively, it is also possible to convey the original to a predetermined position on the platen glass 102 and temporarily stop the same threat, and cause the scanner unit 104 to scan the original from left to right to thereby read the original. This reading method is the so-called stationary original reading method.

In the case of reading an original without using the original feeder 100, first, a user lifts the original feeder 100 and places an original on the platen glass 102, whereafter the scanner unit 104 is caused to scan the original from left to right to read the original. In short, when the original feeder 100 is not used for reading an original, stationary original reading is performed.

The exposure control section 110 of the printer 300 modulates a laser beam based on the video signal output from the image reader 200 and then outputs the modulated laser beam. The laser beam is applied onto a photosensitive drum 111 while being scanned by a polygon mirror 110*a*. On the photosensitive drum 111, an electrostatic latent image is formed according to the scanned laser beam. When stationary original reading is performed, the exposure control section 110 outputs the laser beam, as described hereinafter, such that a proper image (non-mirror image) is formed. The electrostatic latent image formed on the photosensitive drum 111 is visualized as a developer image by a developer supplied from a developing device 113.

On the other hand, a sheet fed by pickup rollers 127, 128 from an upper cassette 114 or a lower cassette 115 disposed within the printer 300 is conveyed to resist rollers 126 by sheet feed rollers 129, 130. When the leading edge of the sheet reaches the resist rollers 126, the resist rollers 126 are driven in desired timing, and convey the sheet between the photosensitive drum 111 and a transfer section 116 in timing in synchronism with the start of laser radiation. The developer image formed on the photosensitive drum 111 is transferred onto the fed sheet by the transfer section 116. The sheet having the developer image transferred thereon is conveyed to a fixing section 117, and the fixing section 117 fixes the developer image on the sheet by heating and pressing the sheet. The sheet having passed through the fixing section 117 passes through a flapper 121 and discharge rollers 118 to be discharged from the printer 300 toward an associated device (folder 400) outside the image forming apparatus main unit.

When the sheet is to be discharged face-down, i.e. with an image-formed surface thereof facing downward, the sheet having passed through the fixing section 117 is temporarily guided into an inverting pass 122 by switching operation of the flapper 121, and then, after the trailing edge of the sheet has passed through the flapper 121, the sheet is switched back to be discharged from the printer 300 by the discharge rollers 118. This sheet discharge mode will be hereinafter referred to as "inverted discharge". The inverted discharge is carried out when images are sequentially formed starting from the leading page, e.g. when images read using the original feeder 100 are formed or when images output from a computer are formed. The sheets thus discharged by the inverted discharge are stacked in the correct order.

When a hard sheet, such as an OHP sheet, is supplied from a manual sheet feeder 125, and an image is formed on this sheet, the sheet is not guided into the inverting path 122, and hence discharged by the discharge rollers 118 face-up, i.e. with an image-formed surface thereof facing upward. Further, when a double-sided recording mode for forming images on both sides of a sheet is set, the sheet is guided into the inverting path 122 by switching operation of the flapper 121, and then conveyed to a double-sided conveying path 124, followed by being fed in again between the photosensitive drum 111 and the transfer section 116 in the timing mentioned above.

The sheet discharged from the printer 300 of the image forming apparatus main unit 10 is sent forward to the folder 400. The folder 400 performs processing for folding the sheet into a Z shape. For example, when the sheet is of a A3 or B4 size and at the same time the folding processing is designated, the folder 400 carries out the folding processing on the sheet discharged from the printer 300. In other cases, the sheet discharged from the printer 300 passes through the folder 400 without being subjected to the folding processing, to be discharged to the finisher 500. The finisher 500 includes an inserter 900 for feeding special sheets, such as covers and interleaved sheets, which are inserted into sheets having images formed thereon, and performs bookbinding processing, binding processing, punch processing, etc.

Figure 2:
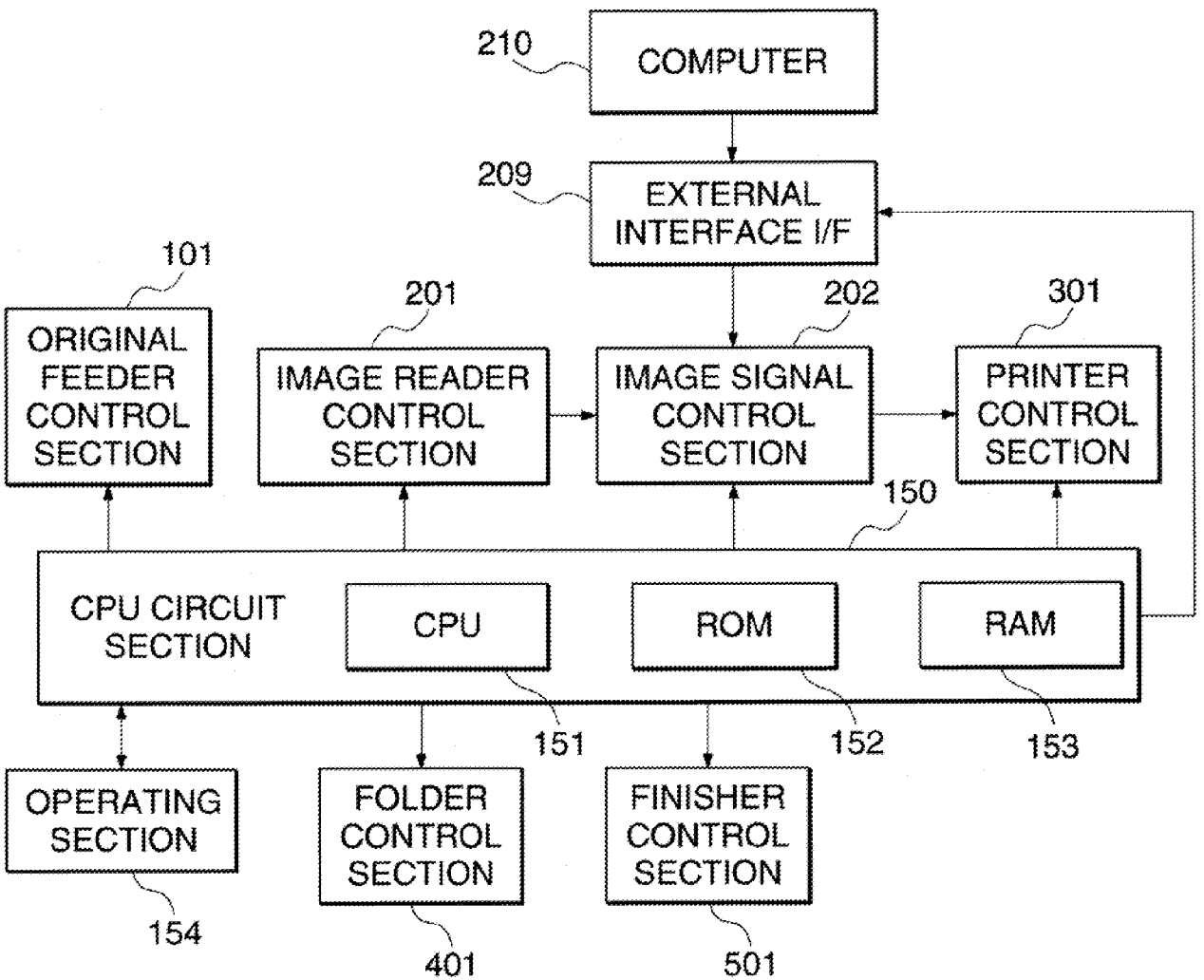
FIG. 2 is a block diagram showing the arrangement of a controller that controls the overall operation of the image forming apparatus shown in FIG. 1.

Next, the arrangement of a controller that controls the overall operation of the present image forming apparatus will be described with reference to FIG. 2, which is a block diagram showing the arrangement of the controller that controls the overall operation of the image forming apparatus shown in FIG. 1. As shown in the FIG. 2, the controller is comprised of a CPU circuit section 150, an original feeder control section 101, an image reader control section 201, the image signal control section 202, a printer control section 301, a folder control section 401, a finisher control section 501, and an external interface (I/F) 209. Reference numeral 154 in FIG. 2 designates an operating section of the image forming apparatus, and reference numeral 210 designates a computer communicable with the image forming apparatus.

The CPU circuit section 150 incorporates a CPU 151, a ROM 152, and a RAM 153, and performs centralized control of the original feeder control section 101, the operating section 154, the image reader control section 201, the image signal control section 202, the external interface (I/F) 209, the printer control section 301, the folder control section 401, and the finisher control section 501, based on control programs stored in the ROM 152. The RAM 153 temporarily stores control data, and is also used as a work area for carrying out arithmetic operations involved in control processing. The original feeder control section 101 controls the original feeder 100 in response to instructions from the CPU circuit section 150. The image reader control section 201 controls the driving of the scanner unit 104, the image sensor 109, and so forth, and transfers an analog image signal output from the image sensor 109 to the image signal control section 202.

The image signal control section 202 converts the analog image signal from the image sensor 109 to a digital signal, then performs various kinds of processing on the digital signal, and converts the processed digital signal to a video signal, followed by delivering the video signal to the printer control section 301. Further, the image signal control section 202 performs various kinds of processing on a digital image signal input from the computer 210 via the external I/F 209, and converts the processed digital image signal to a video signal, followed by delivering the video signal to the printer control section 301. The processing operations executed by the image signal control section 202 are controlled by the CPU circuit section 150. The printer control section 301 drives the exposure control section 110 based on the received video signal. The operating section 154 includes a plurality of keys for configuring various functions for image formation, and a display section for displaying information indicative of the configurations. The operating section 154 outputs key signals corresponding to respective operations of keys to the CPU circuit section 150, and displays the corresponding pieces of information on the display section based on signals from the CPU circuit section 150.

The folder control section 401 is incorporated in the folder 400, and exchanges information with the CPU circuit section 150 to thereby control the overall operation of the folder 400. The finisher control section 501 is incorporated in the finisher 500, and exchanges information with the CPU circuit section 150 to thereby control the overall operation of the finisher 500. These control processes will be described in detail hereinafter.

Figure 3:
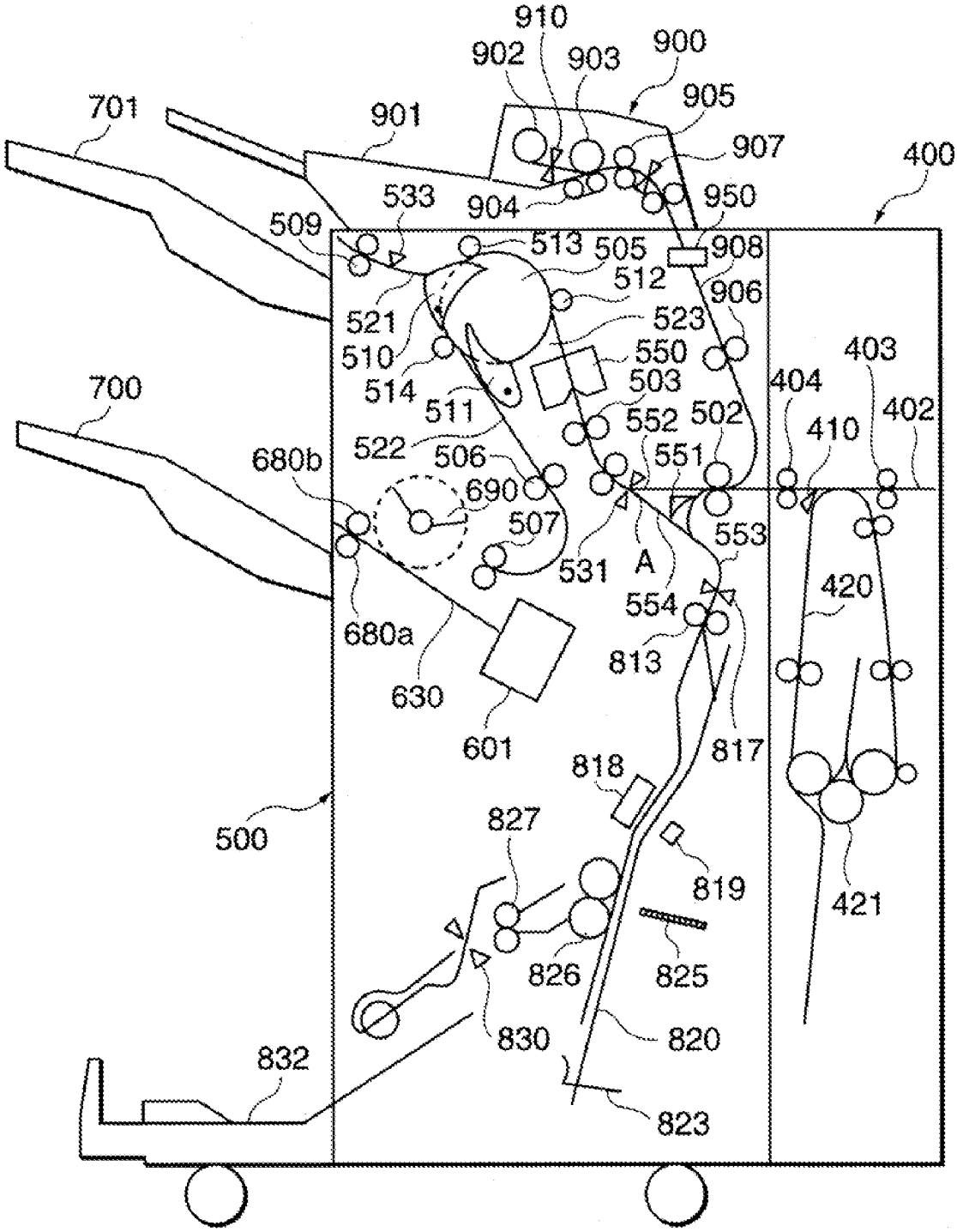
FIG. 3 is a diagram schematically illustrating the internal construction of a folder 400 and a finisher 500 appearing in FIG. 1.

Next, the respective arrangements of the folder 400 and the finisher 500 provided in the image forming apparatus will be described with reference to FIG. 3, which is a diagram showing the internal construction of the folder 400 and that of the finisher 500. As shown in FIG. 3, the folder 400 has a horizontal folding/conveying path 402 for introducing a sheet discharged from the printer 300 of the image forming apparatus main unit 10, and guiding the sheet to the finisher 500. On the horizontal folding/conveying path 402, there are arranged feed roller pairs 403 and feed roller pairs 404. Further, in the outlet of the horizontal folding/conveying path 402 (toward the finisher 500), there is arranged a folding path-selecting flapper 410. The folding path-selecting flapper 410 performs a switching operation for selectively guiding a sheet on the horizontal folding/conveying path 402 to a folding path 420 or the finisher 500.

When folding processing is carried out, the folding path-selecting flapper 410 is switched on, whereby the sheet is guided to the folding path 420. The sheet guided to the folding path 420 is conveyed to folding rollers 421 to be folded into a Z shape. On the other hand, when folding processing is not carried out, the folding path-selecting flapper 410 is switched off, whereby the sheet is directly sent forward from the printer 300 to the finisher 500 via the horizontal folding/conveying path 402.

The finisher 500 performs sheet post-processing including staple processing for sequentially taking in sheets discharged via the folder 400, aligning the sheets taken in into a bundle, and stapling the trailing edge of the sheet bundle, punch processing for punching holes in the trailing edge side of the sheet bundle, sort processing for sorting sheets, non-sort processing for not sorting sheets, and bookbinding processing for binding the sheets into a book.

As shown in FIG. 3, the finisher 500 has an inlet roller pair 502 for introducing a sheet discharged from the printer 300 of the image forming apparatus main unit 10 via the folder 400 into the finisher 500. At a location downstream of the inlet roller pair 502, there is arranged a switching flapper 551 for guiding sheets to a finisher path 552 or a first bookbinding path 553. A sheet guided to the finisher path 552 is sent to a buffer roller 505 via a conveying roller pair 503. The conveying roller pair 503 and the buffer roller 505 are capable of performing normal and reverse rotations.

An inlet sensor 531 is disposed between the inlet roller pair 502 and the conveying roller pair 503. A second bookbinding path 554 branches off from the finisher path 552 at a location close to the upstream side of the inlet sensor 531 in the sheet conveying direction. This branch will be hereinafter referred to as the branch A. The branch A forms a branch to a conveying path for conveying a sheet from the inlet roller pair 502 to the conveying roller pair 503, and has a one-way mechanism for conveying a sheet exclusively along the second bookbinding path 554 when the conveying roller pair 503 performs reverse rotation to convey the sheet from the conveying roller pair 503 side toward the inlet sensor 531.

Between the conveying roller pair 503 and the buffer roller 505, there is disposed a punch unit 550 which is operated, as required, to punch holes in the trailing edge side of a sheet conveyed thereto. The buffer roller 505 is capable of winding a predetermined number of sheets conveyed thereto in a stacked state, around the outer periphery thereof, and sheets are held around the outer periphery of the buffer roller 505, as required, by pressing rollers 512, 513, 514. The sheets wound around the outer periphery of the buffer roller 505 are conveyed in a direction of rotation of the buffer roller 505.

A switching flapper 510 is disposed between the pressing rollers 513, 514, while a switching flapper 511 is disposed at a location downstream of the pressing roller 514. The switching flapper 510 serves to peel off the sheets wound around the buffer roller 505 to guide the sheets to a non-sort path 521 or a sort path 522. On the other hand, the switching flapper 511 serves to peel off the sheets wound around the buffer roller 505 to guide the sheets to the sort path 522, or guiding the sheets to a buffer path 523 in the state wound around the buffer roller 505.

Sheets guided to the non-sort path 521 by the switching flapper 510 are discharged onto a sample tray 701 via a discharge roller pair 509. In an intermediate portion of the non-sort path 521, there is disposed a sheet discharge sensor 533 for detecting a jam and the like. Sheets guided to the sort path 522 by the switching flapper 510 are stacked onto an intermediate tray (hereinafter referred to as the processing tray) 630 via a feed roller pair 506 and a discharge roller pair 507. The sheets stacked on the processing tray 630 as a bundle are subjected to the aligning processing, the staple processing, and so forth, as required, followed by being discharged onto a stack tray 700 by discharge rollers 680*a*, 680*b*. A stapler 601 is used in the staple processing for stapling the bundled sheets stacked on the processing tray 630. The operation of the stapler 601 will be described in detail hereinafter. The sample tray 701 and the stack tray 700 are configured to be vertically self-movable. Further, the sample tray 701 cannot only receive sheets discharged through the non-sort path 521, but also move downward to receive sheets discharged from the processing tray 630.

Sheets from the first bookbinding path 553 and the second bookbinding path 554 are fed by a feed roller pair 813 and received into a receiving guide 820, and then further conveyed to a position where the leading edge of the sheet bundle is brought into contact with a movable sheet positioning member 823. A bookbinding inlet sensor 817 is disposed at a location upstream of the feed roller pair 813. Further, at a location facing an intermediate portion of the receiving guide 820, there are arranged two pairs of staplers 818, which cooperate with an anvil 819 to staple the center of the sheet bundle.

A folding roller pair 826 is disposed at a location downstream of the staplers 818. At a location opposed to the folding roller pair 826, there is disposed a thrust member 825. The thrust member 825 is thrust toward a sheet bundle received in the receiving guide 820 to thereby push out the sheet bundle in between the folding roller pair 826. The sheet bundle is folded by the folding roller pair 826, and then discharged onto a saddle discharge tray 832 via folded sheet discharge rollers 827. A bookbinding/sheet discharge sensor 830 is disposed at a location downstream of the folded sheet discharge rollers 827. To fold a bundle of sheets stapled by the staplers 818, after the stapling is completed, the positioning member 823 is moved downward by a predetermined distance to cause a stapled portion of the sheet bundle to be positioned at the center of the folding roller pair 826.

An inserter 900 is disposed on top of the finisher 500. The inserter 900 sequentially separates covers and/or interleaved sheets stacked in a bundle on a tray 901, and then conveys the separated sheets one by one to the finisher path 552 or the first bookbinding path 553. On the tray 901 of the inserter 900, special sheets are each stacked in normal orientation, as viewed from a user's position in front of the apparatus, i.e. in a state of a front surface thereof being set face-up and the top and bottom of an image on the front surface being set in a normal direction as viewed from the user's position. The special sheets stacked on the tray 901 are fed by a feed roller 902 to a separator section comprised of a conveyor roller 903 and a separating belt 904, to be sequentially separated one by one from the top sheet, and then conveyed to the finisher path 552 or the first bookbinding path 553.

A pull-off roller pair 905 is disposed at a location downstream of the separator section. Each special sheet separated by the pull-off roller pair 905 is stably guided to a conveying path 908. A sheet feed sensor 907 is disposed at a location downstream of the pull-off roller pair 905. Further, between the sheet feed sensor 907 and the inlet roller pair 502, there are arranged conveyor rollers 906 for guiding the special sheet on the conveying path 908 to the inlet roller pair 502. In an intermediate portion of the conveying path 908, there is disposed a multiple-feed detecting sensor 950 for detecting whether or not two or more separated special sheets overlap each other while being fed from the tray 901.

Figure 4:
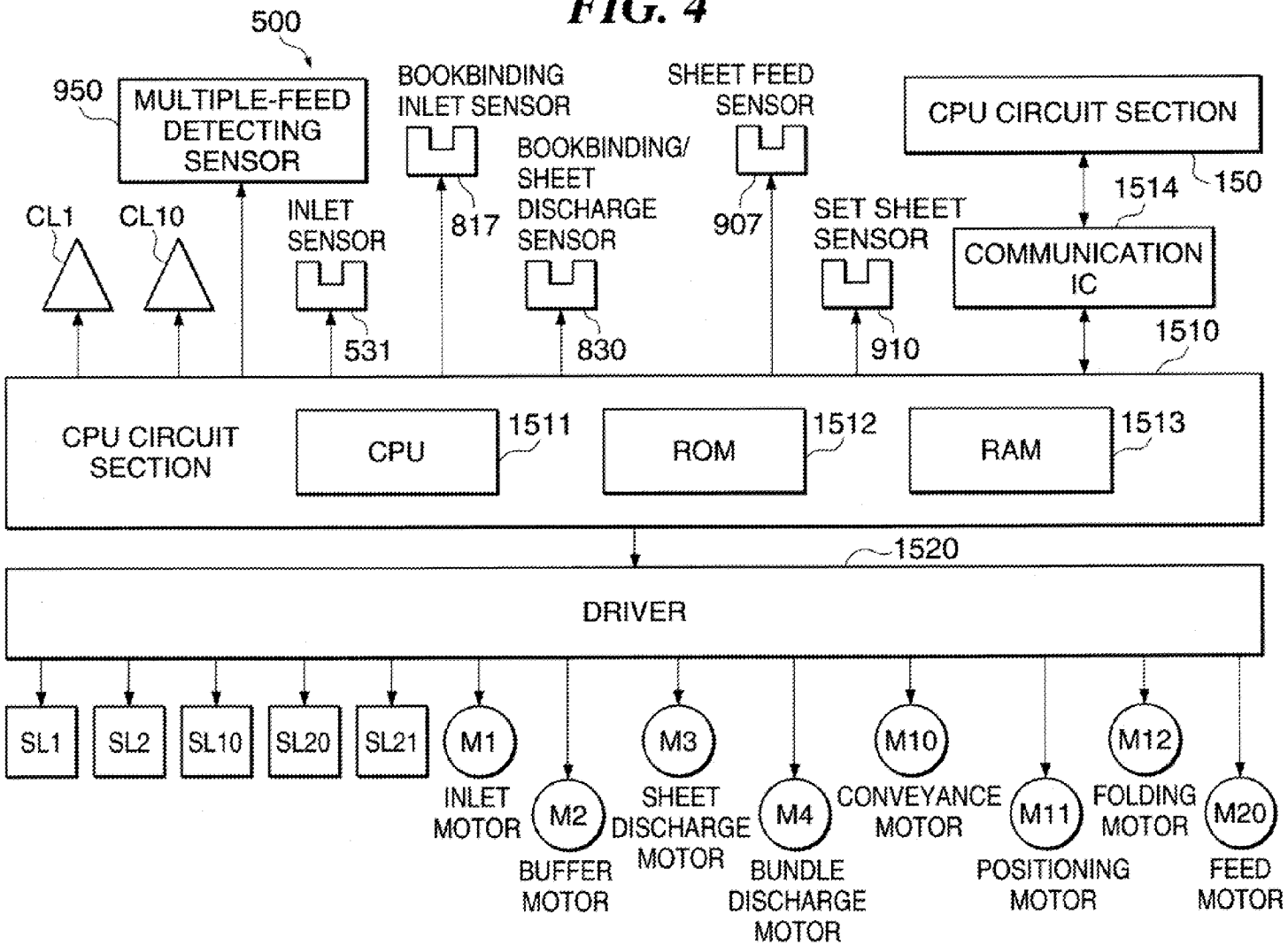
FIG. 4 is a block diagram showing the configuration of a finisher control section 501 appearing in FIG. 2.

Next, the arrangement of the finisher control section 501 that drivingly controls the finisher 500 will be described in detail with reference to FIG. 4, which is a diagram showing the configuration of the finisher control section 501 appearing in FIG. 2. As shown in FIG. 4, the finisher control section 501 includes a CPU circuit section 1510 comprised of a CPU 1511, a ROM 1512, and a RAM 1513. The CPU circuit section 1510 communicates with the CPU circuit section 150 provided in the image forming apparatus main unit 10 via a communication IC 1514, for data exchange, and executes various programs stored in the ROM 1512 to drivingly controls the finisher 500 according to instructions from the CPU circuit section 150.

To drivingly control the finisher 500, the CPU circuit section 1510 receives detection signals from various sensors. The various sensors include the inlet sensor 531, the binding inlet sensor 817, the bookbinding/sheet discharge sensor 830, the sheet feed sensor 907, a set sheet sensor 910, and the multiple-feed detecting sensor 950. The set sheet sensor 910 detects whether or not sheets are set on the tray 901 of the inserter 900. The multiple-feed detecting sensor 950 detects, as described above, whether or not two or more separated special sheets are being conveyed from the tray 901 while overlapping each other. The multiple-feed detecting sensor 950 is comprised of a fixed electrode and a movable electrode opposed to each other, and detects the thickness of a special sheet or special sheets passing the sensor position from the electrostatic capacity thereof with the sheet(s) passing the sensor position sandwiched between the two electrodes. However, the construction of the multiple-feed detecting sensor 950 is not limited to the above construction, but any other construction enabling detection of multiple feed of sheets may be employed.

A driver 1520 is connected to the CPU circuit section 1510. The driver 1520 drives various motors and solenoids in response to signals from the CPU circuit section 1510. Further, the CPU circuit section 1510 drives clutches. The various motors include an inlet motor M1 serving as a drive source of the inlet roller pair 502, the conveying roller pair 503, and the conveying roller pair 906, a buffer motor M2 serving as a drive source of the buffer roller 505, a sheet discharge motor M3 serving as a drive source of the feed roller pair 506, the discharge roller pair 507 and the discharge roller pair 509, a bundle discharge motor M4 serving as a drive source of the discharge rollers 680*a* and 680*b*, a conveyance motor M10 serving as a drive source of the conveying roller pair 813, a positioning motor M11 serving as a drive source of the sheet positioning member 823, a folding motor M12 serving as a drive source of the thrust member 825, the folding roller pair 826, and the folded sheet discharge roller pair 827, and a feed motor M20 serving as a drive source of the feed roller 902, the conveyor roller 903, the separating belt 904, and the pull-off roller pair 905 of the inserter 900.

The inlet motor M1, the buffer motor M2, and the discharge motor M3 are each formed by a stepper motor. The motors M1, M2 and M3 are capable of driving the roller pairs for rotation at the same speed or at their own speeds by controlling duty factors of excitation pulses supplied thereto. Further, the inlet motor M1 and the buffer motor M2 can be driven for normal and reverse rotations by the driver 1520. The conveyance motor M10 and the positioning motor M11 are each formed by a stepper motor, and the folding motor M12 is formed by a DC motor. The conveyance motor M10 is configured to be capable of conveying sheets in synchronism with the inlet motor M1 in respect of speed. The feed motor M20 is also formed by a stepper motor, and configured to be capable of feeding sheets in synchronism with the inlet motor M1 in respect of speed.

The solenoids include a solenoid SL1 for switching the switching flapper 510, a solenoid SL2 for switching the switching flapper 511, a solenoid SL10 for switching the switching flapper 551, a solenoid SL20 for driving a feed shutter, not shown in FIG. 3, of the inserter 900, and a solenoid SL21 for lifting and lowering the feed roller 902 of the inserter 900. Further, the clutches include a clutch CL1 for transmitting the driving force of the folding motor M12 to the thrust member 825, and a clutch CL10 for transmitting the driving force of the feed motor M20 to the feed roller 902.

Next, a description will be given of an example of operation for setting up a post-processing mode using the operating section 154 of the image forming apparatus shown in FIG. 1 with reference to FIGS. 5A to 5C, which are diagrams showing examples of screens displayed for the selection of the post-processing mode. In the present embodiment, the post-processing mode includes a non-sort mode, a sort mode, a staple sort mode (binding mode), a bookbinding mode, and so forth. Further, an interleaved sheet mode can also be selected in which insert sheets including covers and back covers are inserted into ordinary sheets. These modes are set or configured by input operations from the operating section 154.

Figure 5A:
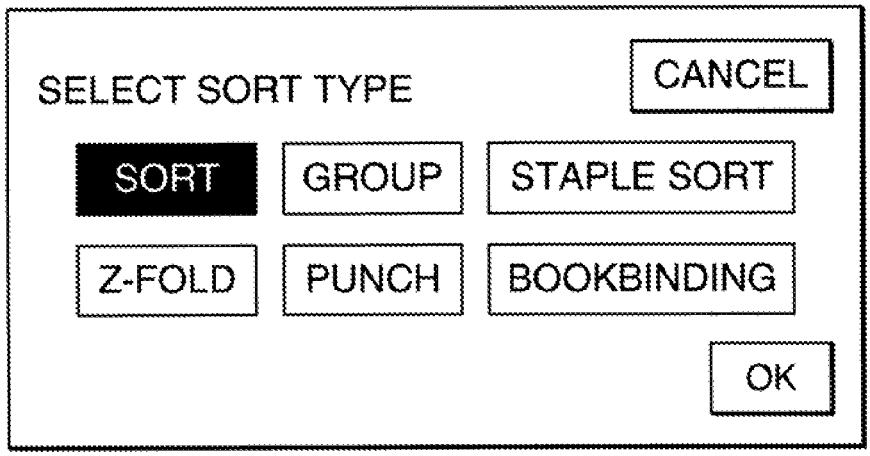
Figure 5B:
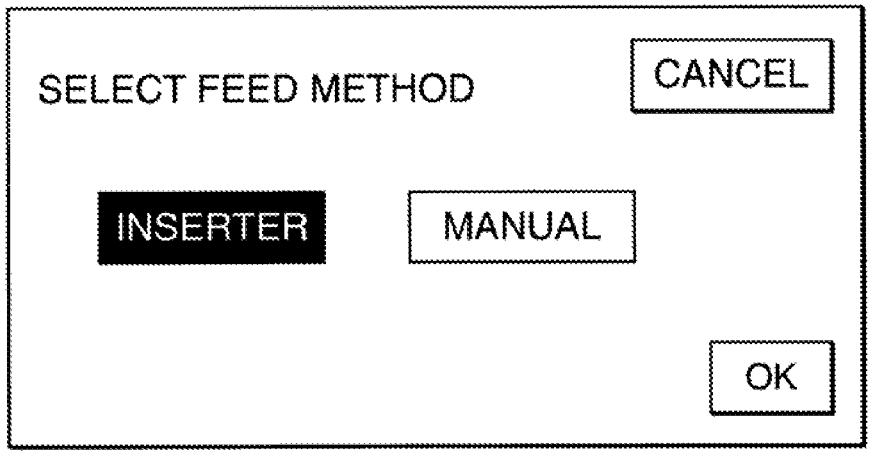
Figure 5C:
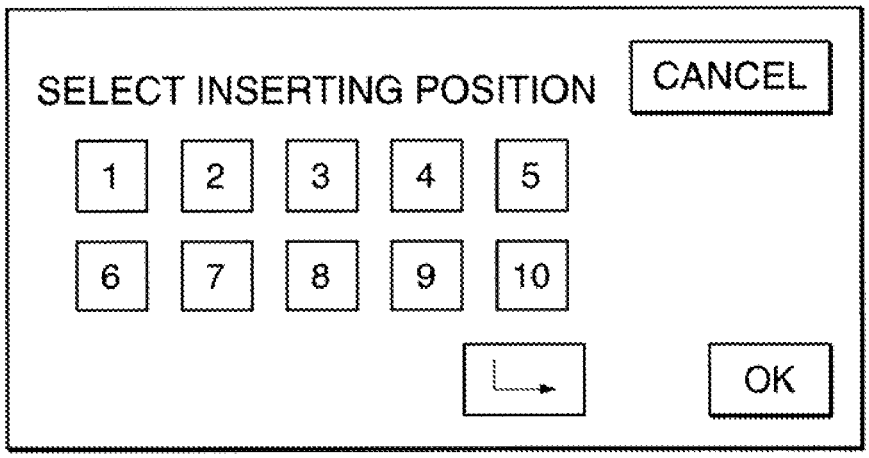

When setting up the post-processing mode, a menu option-selecting screen shown in FIG. 5A, for example, is displayed on the operating section 154, and the post-processing mode is set via this menu option-selecting screen. Further, when the interleaved sheet mode is set, a setting screen shown in FIG. 5B is displayed on the operating section 154, and a special sheet insert mode is set via this setting screen. Specifically, the special sheet insert mode is for allowing the user to set whether insertion of a special sheet is to be carried out from the inserter 900 or from the manual sheet feeder 125. Further, using a setting screen shown in FIG. 5C, it is possible to set an inserting position of the sheet in the sheets of a sheet bundle. In the case of using a special sheet only as a cover, a button "1" alone is selected, whereas when it is necessary to insert a plurality of special sheets, it is possible to select buttons corresponding to respective desired inserting positions in terms of page numbers.

Figure 6A:
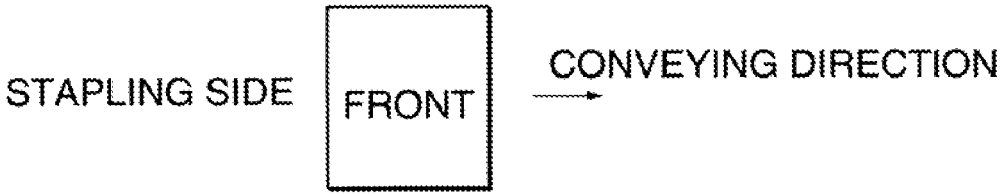
Figure 6B:
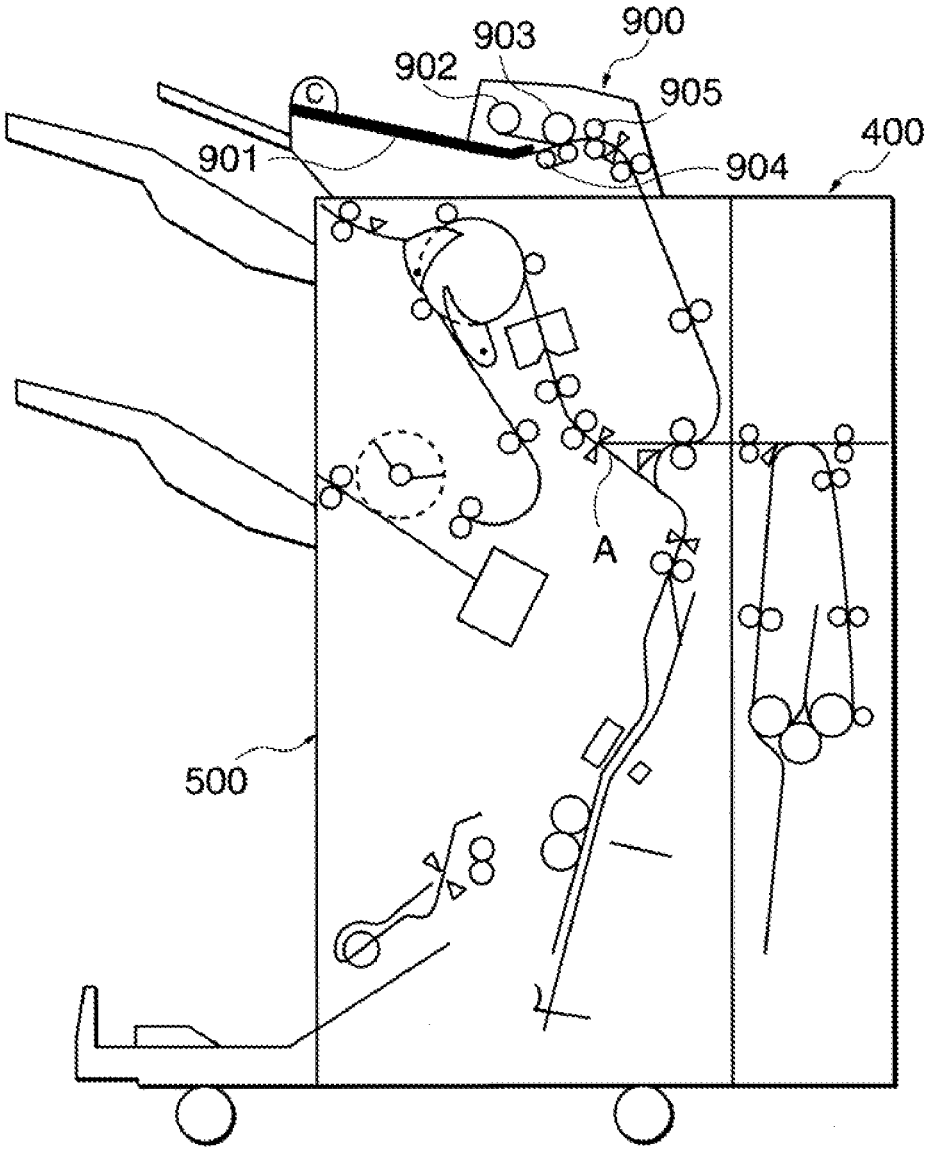

Next, a description will be given of how sheets are conveyed in the sort mode from the inserter 900 and the printer 300 to the processing tray 630 within the finisher 500 with reference to FIGS. 6A to 11, which are diagrams useful in explaining the flow of sheets in the image forming apparatus shown in FIG. 1 from the inserter 900 and the printer 300 to the processing tray 630 within the finisher 500 in the sort mode. In FIGS. 6B et seq., sheets are designated by bold solid lines with a semi-circled "C" or "P" attached to one end thereof.

When sheets C are to be inserted as a cover for each bundle of sheets having images formed thereon, they are set on the tray 901 of the inserter 900, as shown in FIG. 6B. Each sheet C is set, as shown in FIG. 6A, with a front image-formed surface thereof facing upward and a binding side thereof positioned on the left side as viewed from the user's position in front of the apparatus, and is fed in a direction indicated by the arrow in FIG. 6A. The sheets C are thus set in the same manner with respect to the user's position as originals set in the original feeder 100, which makes it possible to improve operability in the setting of the sheets C.

Figure 7:
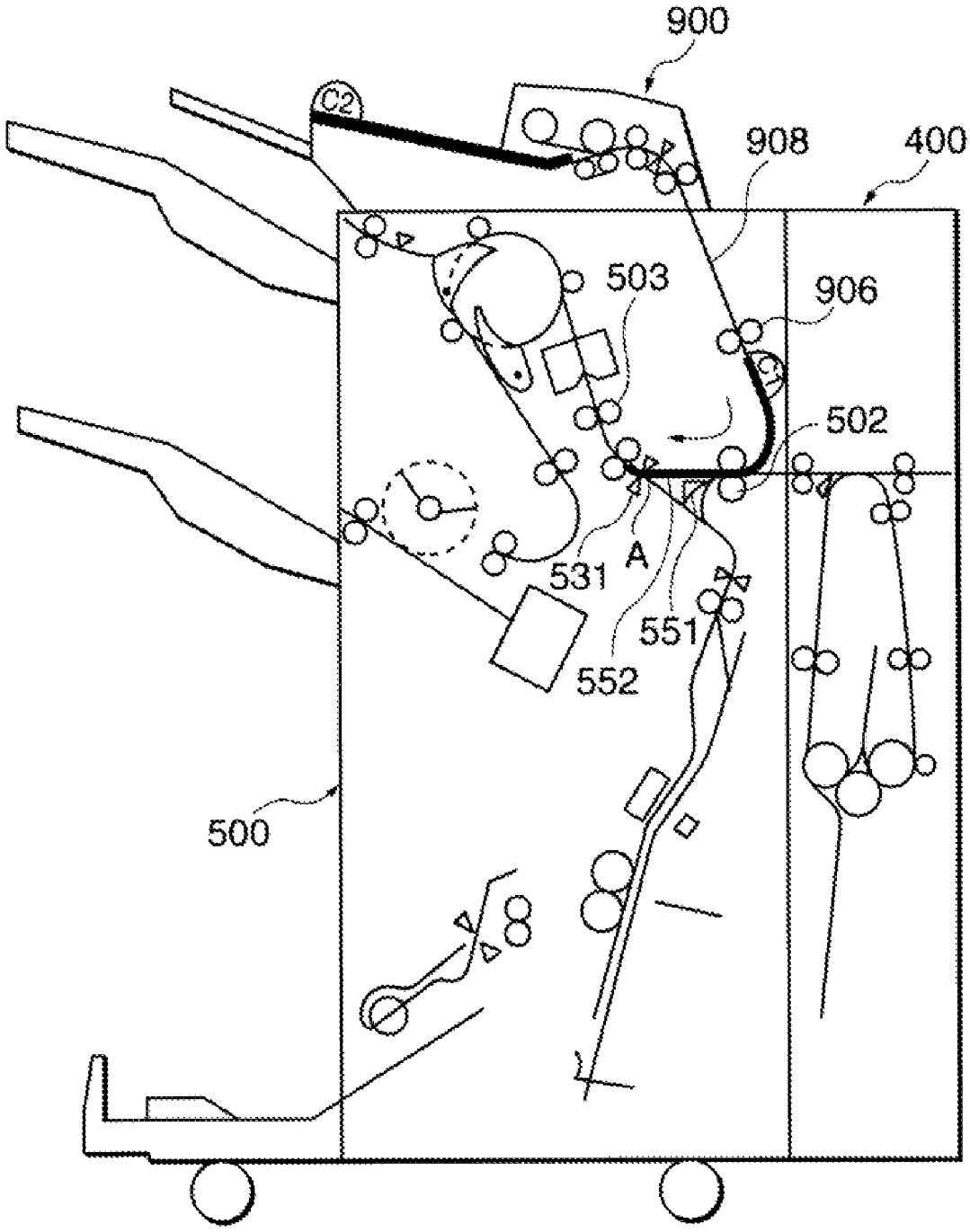
FIGS. 7 to 11 are diagrams useful in explaining the flow of sheets in the image forming apparatus shown in FIG. 1 from the inserter 900 and the printer 300 to the processing tray 630 within the finisher 500 in the sort mode.

After the sheets C are set on the tray 901, the top sheet C1 starts to be fed, and the switching flapper 551 is switched to the finisher path 552, as shown in FIG. 7. The sheet C1 is guided through the conveying path 908 into the finisher path 552 via the inlet roller pair 502. When the leading edge of the sheet C1 is detected by the inlet sensor 531, a sheet with an image formed thereon (sheet P1 shown in FIG. 8) starts to be fed from the printer 300 of the image forming apparatus main unit 10.

Figure 8:
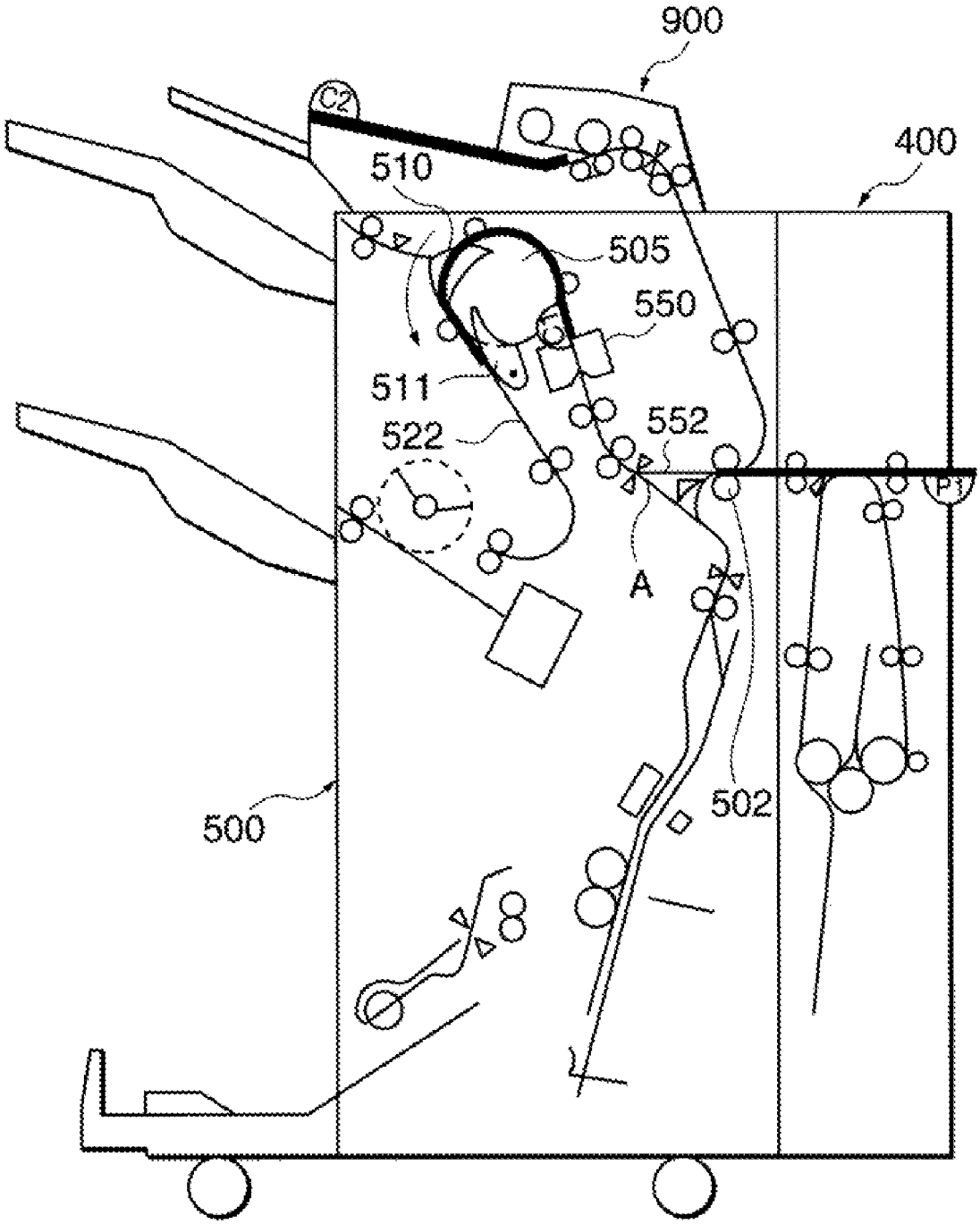
Figure 9:
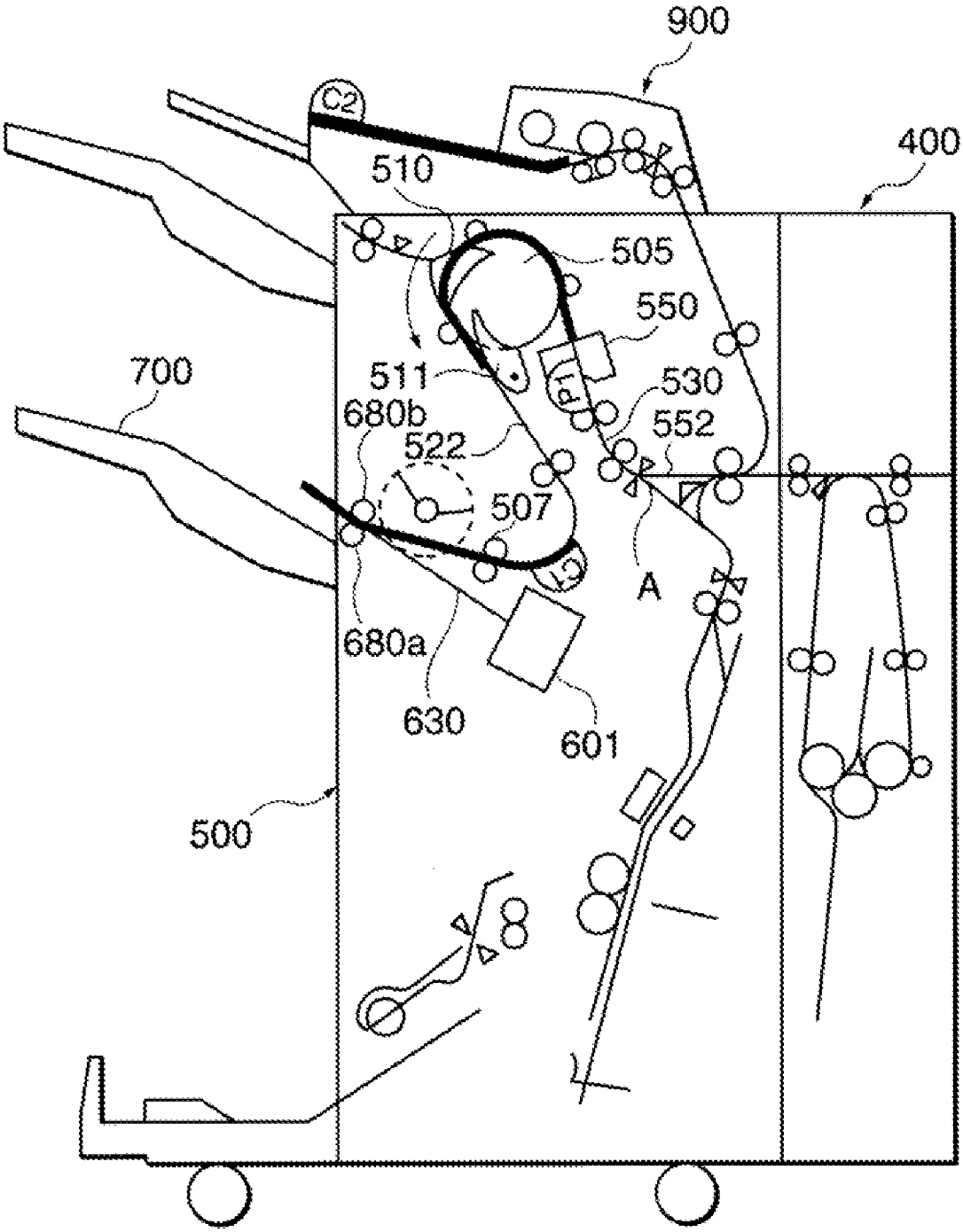

Then, as shown in FIG. 8, the sheet P1 fed from the printer 300 is introduced into the finisher 500, and the sheet C1 is guided into the sort path 522 via the buffer roller 505. At this time, the switching flappers 510, 511 have been both switched to the sort path 522. As shown in FIG. 9, the sheet C1 having been guided into the sort path 522 is received on the processing tray 630.

Figure 10:
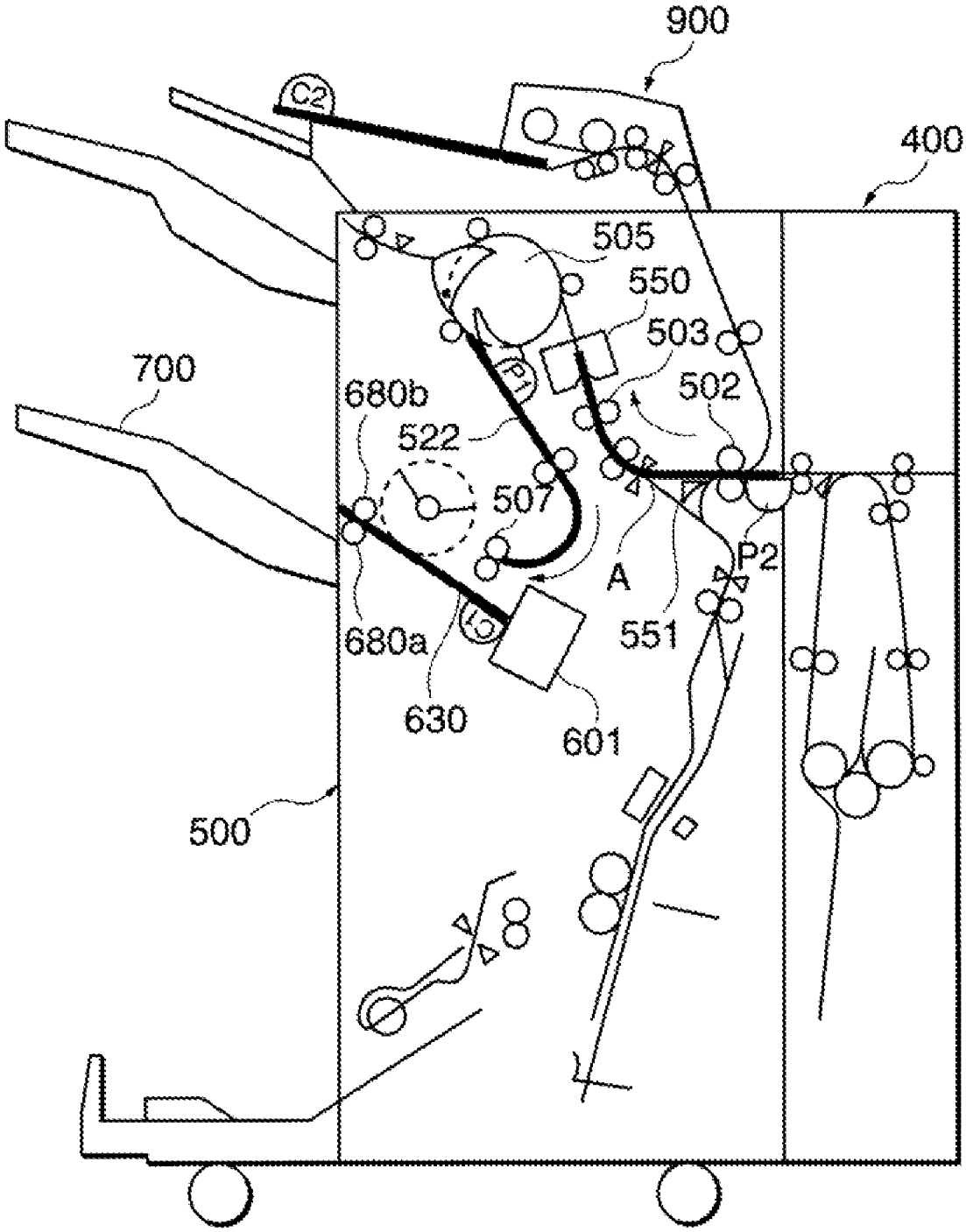
Figure 11:
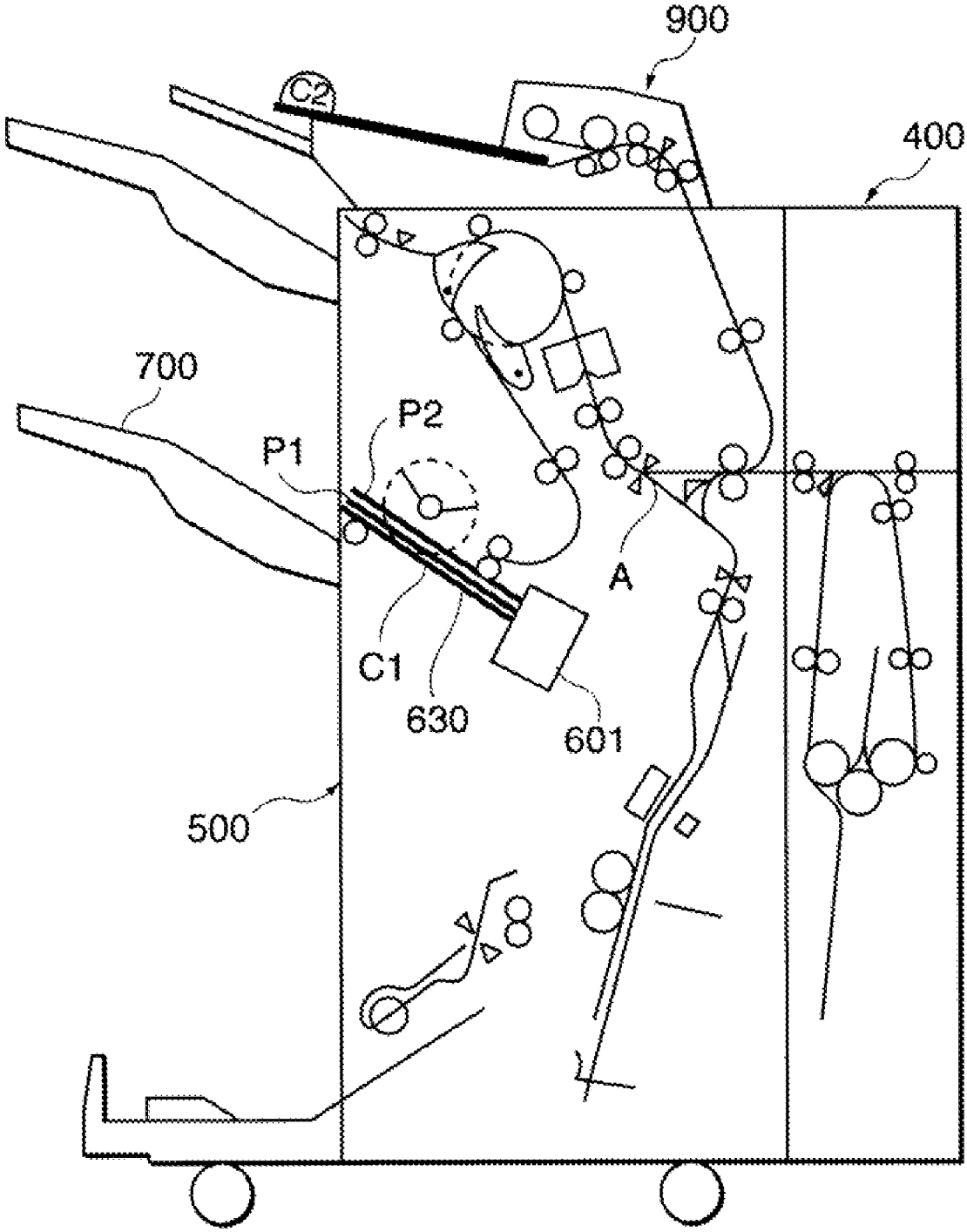

At this time, the sheet P1 from the printer 300 has been guided into the finisher path 552. Then, as shown in FIG. 10, similarly to the sheet C1, the sheet P1 is guided into the sort path 522 via the buffer roller 505, and conveyed toward the processing tray 630, while a sheet P2 that follows the sheet P1 has been introduced into the finisher path 552. Then, as shown in FIG. 11, the sheet P1 is received on the processing tray 630 such that it is stacked on the sheet C1 that has already been received on the processing tray 630, and then the sheet P2 is received on the processing tray 630 and stacked on the sheet P1.

Each of the sheets P1, P2 has an image formed thereon whose top and bottom have been set in proper positions by mirror image correction processing. Since the sheets P1, P2 are discharged by inverted discharge, the sheets P1, P2 are received on the processing tray 630 with their image-formed surfaces facing downward and their binding sides directed toward the stapler 601, as is the case with the sheet C1. Although not shown in FIG. 11, when there is a special sheet to be inserted into a sheet bundle to be processed next, the special sheet is fed into the conveying path 908 and kept on standby while the sheets P1, P2 which constitute the current bundle are being conveyed. Thus, productivity in the sort-mode operation can be improved.

Next, a description will be given of how images are formed in the bookbinding mode with reference to FIGS. 12A to 12D, which are useful in explaining a process of image formation in the bookbinding mode of the image forming apparatus shown in FIG. 1. When the bookbinding mode is designated, originals set on the original feeder 100 are read sequentially from the top page. The images of the originals are sequentially stored on a hard disk, not shown, of the image forming apparatus main unit 10, and the number of originals read is counted at the same time.

When the reading of the originals is completed, the read set of original images is classified according to the following equation (1), to determine an image-forming sequence and image-forming positions.

$$M=n\times 4-k \tag{1}$$

wherein M represents the number of originals, n an integer equal to or larger than 1, corresponding to the number of sheets, and k a value of 0, 1, 2 or 3.

A detailed description of control of the image-forming sequence and the image-forming positions is omitted.

Figure 12A:
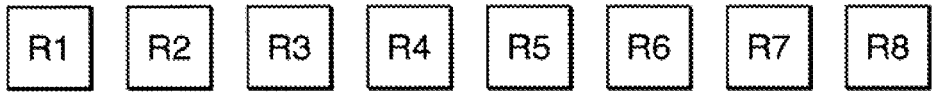
Figure 12B:
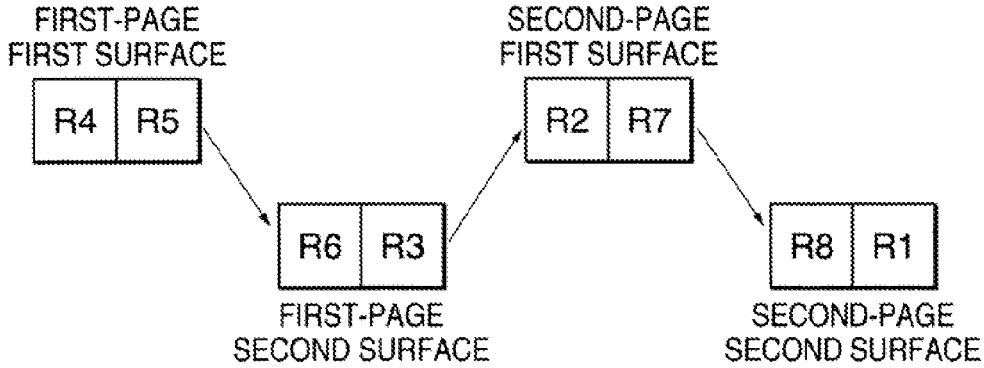

Let it be assumed that eight originals are read for forming images thereof in the bookbinding mode. As shown in FIG. 12A, image data of the originals corresponding to the eight pages (R1 to R8) are stored on the hard disk, not shown, in the order of reading, and the image-forming sequence and the image forming positions of original image data (R1 to R8) are determined. Based on results of the determination, after the above-mentioned mirror image correction processing has been performed, an image R4 is formed on the left half of the first surface (front surface) of the first-page sheet P1, and an image R5 is formed on the right half of the same, as shown in FIG. 12B. Then, the sheet P1 is guided into the double-sided conveying path 124.

Figure 12C:
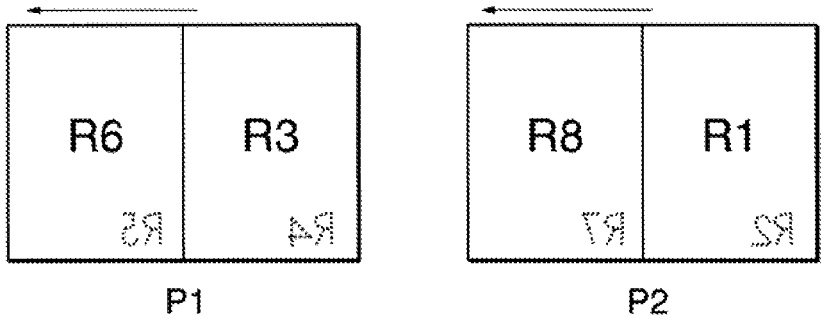

The sheet P1 is fed to the transfer section 116 again, where an image R6 is formed on the left half of the second surface (back surface) of the sheet P1, and an image R3 is formed on the right half of the same. The sheet P1 having images thus formed on both sides thereof is discharged by inverted discharge, and then fed into the bookbinding path 553 in the finisher 500. As a result of this inverted discharge, as shown in FIG. 12C, the sheet P1 is conveyed in a direction indicated by an arrow in FIG. 12C with the second surface having the images R6 and R3 formed thereon facing upward and with the image R6 in the leading position.

Then, an image R2 is formed on the left half of the first surface (front surface) of the second-page sheet P2, and an image R7 is formed on the right half of the same. The sheet P2 is then guided into the double-sided conveying path 124. Then, the sheet P2 is fed to the transfer section 116 again, where an image R8 is formed on the left half of the second surface (back surface) of the sheet P2, and an image R1 is formed on the right half of the same. The sheet P2 is discharged by inverted discharge, and then conveyed to the bookbinding path 553 in the finisher 500. As a result of this inverted discharge, as shown in FIG. 12C, the sheet P2 is conveyed in a direction indicated by an arrow in FIG. 12C, with the second surface having the images R8 and R1 thus formed thereon facing upward and with the image R8 in the leading position.

Figure 12D:
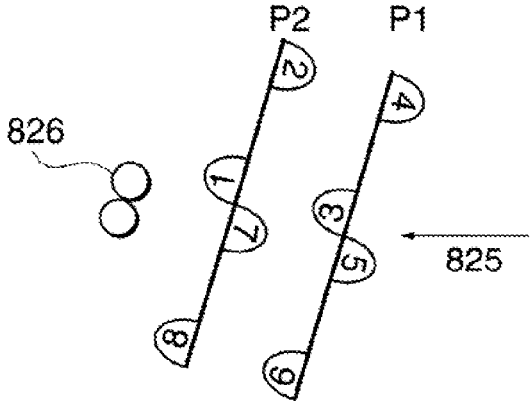

The sheets P1, P2 are guided through the first bookbinding path 553 in the finisher 500 into the receiving guide 820 and stored therein. As shown in FIG. 12D, in the receiving guide 820, the sheet P1 is received on the thrusting member 825 side and the sheet P2 is received on the folding roller pair 826 side. The sheets P1, P2 are received with their first surfaces facing toward the thrusting member 825. The positioning member 823 positions the sheets P1, P2 in the receiving guide 820.

Figure 13:
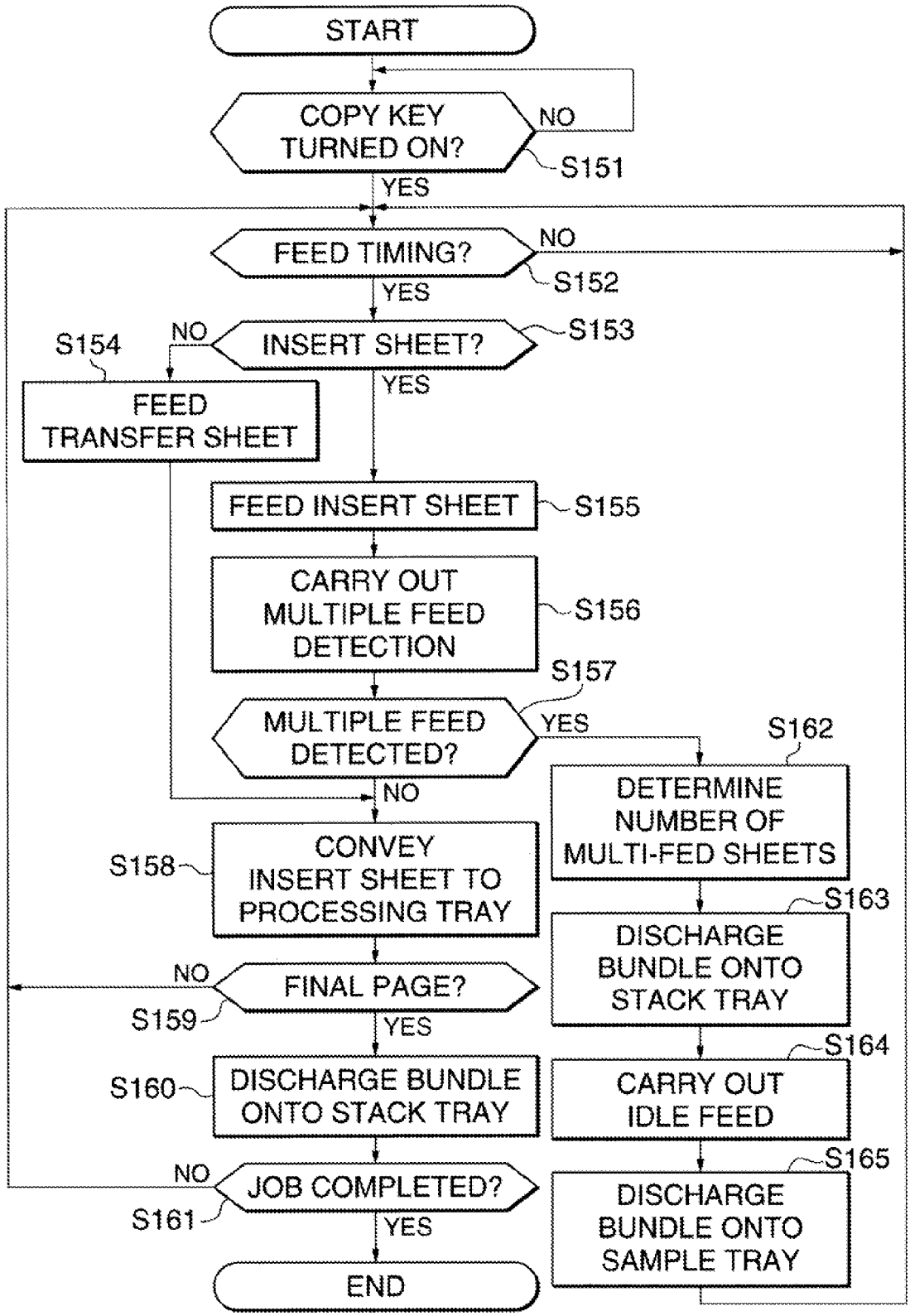
FIG. 13 is a flowchart of an inserter process carried out in the interleaved sheet mode by the image forming apparatus shown in FIG. 1.

Next, an inserter process carried out in the interleaved sheet mode by the image forming apparatus shown in FIG. 1 will be described with reference to a flowchart shown in FIG. 13. The present embodiment is applied to a case of preparing one bundle of sheets using the inserter 900, e.g. a case where, assuming that a bundle of six sheets is to be formed, special sheets as second, third and sixth sheets of the bundle are fed from the inserter 900 to the finisher 500, and the other sheets as first, fourth and fifth sheets of the bundle are fed to the finisher 500 as respective sheets having images formed thereon, thereby forming the six sheets into one bundle. In the following, a description will be given of the above case by way of example. It should be noted that the CPU circuit section 150 as a controller executes processing for the image forming apparatus main unit 10, while the finisher control section 501 executes processing for the finisher 500, under the control of the CPU circuit section 150.

Figure 14:
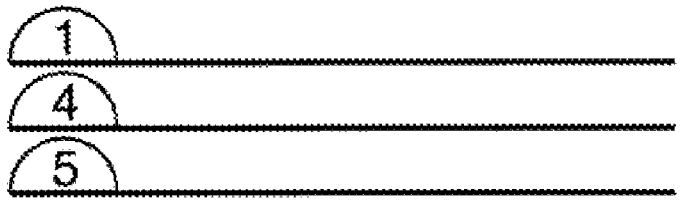
FIG. 14 is a diagram schematically illustrating originals stacked on an original feeder in an interleaved sheet mode of the image forming apparatus shown in FIG. 1.
Figure 15:
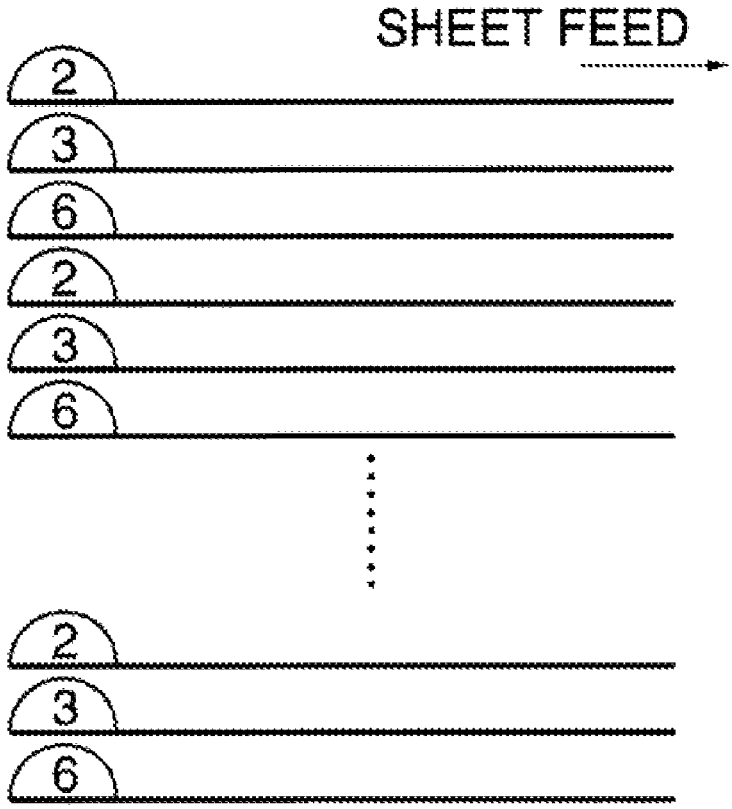
FIG. 15 is a diagram schematically illustrating insert sheets stacked on an inserter in the interleaved sheet mode of the image forming apparatus shown in FIG. 1.

Positions of special sheets fed from the inserter 900 in the sheets of a sheet bundle to be prepared can be set on a-special-sheet-by-special-sheet-basis via the operating section 154 of the image forming apparatus main unit 10. Further, in the case of preparing a plurality of sheet bundles, special sheets are set on the tray 901 of the inserter 900 in the order of feeding (i.e. in a state in which a plurality of sets of special sheets for the respective sheet bundles are stacked one upon another). More specifically, in the above example, the second, third, and sixth special sheets of a first bundle, the second, third, and sixth special sheets of a second bundle, and so forth are set in the mentioned order. In this case, as shown in FIG. 14, the first, fourth, and fifth originals are stacked on the original tray of the original feeder 100. On the other hand, in the inserter 900, sets of three special sheets, i.e. the second, third, and sixth special sheets, the number of sets corresponding to the number of sheet bundles to be prepared, are stacked.

When the user designates the sheet feeding sequence from the inserter 900 via the operating section 154 of the image forming apparatus main unit 10, and turns on a copy starting key of the operating section 154 (YES to step S151), the image forming apparatus main unit 10 controls timing for feeding sheets to have images formed thereon, and insert sheets supplied from the inserter 900 (step S152). The CPU circuit section 150 of the image forming apparatus main unit 10 determines whether or not a first sheet is to be fed from the inserter 900, based on the settings made via the operating section 154 (step S153). In the above example, the first sheet is fed from the image forming apparatus main unit 10 (NO to step S153). More specifically, a sheet (transfer sheet) fed from the cassette 114 or the cassette 115 in advance and conveyed to the resist rollers 126 to be kept on standby is conveyed to the transfer section 116 (step S154).

On the other hand, if it is time to feed a insert sheet (second sheet in the above example) from the inserter 900 (YES to step S153), the CPU circuit section 150 of the image forming apparatus main unit 10 issues an instruction to the finisher 500 for feeding an insert sheet from the inserter 900. When the insert sheet is fed to the finisher 500 from the inserter 900 (step S155), the finisher control section 501 carries out a multiple-feed determination (multiple-feed detection) for determining, based on a detection signal from the multiple-feed detecting sensor 950, whether or not multiple feed of insert sheets fed from the inserter 900 has occurred (step S156).

A brief description will now be given of the multiple-feed determination. For execution of the multiple-feed determination, in the interleaved sheet mode, the thickness of each insert sheet is measured in advance by the multiple-feed detecting sensor 950 when a first bundle is prepared, and the resulting data is stored on a page-by-page basis (as d1, d2, . . . , dn (1 to n each represent a page number)) in the RAM 1513 of the CPU circuit section 1510 of the finisher control section 501. This sheet thickness data is used as a reference value for determining multiple feed of sheets in a second and following sheet bundle. In preparation of the second and following sheet bundles, the thickness of each insert sheet is measured by the multiple-feed detecting sensor 950 as the sheet passes the sensor 950, and sheet thickness data Xn for an n-th page, for example, is compared with the sheet thickness data dn stored in the RAM 1513.

If it is judged in the above multiple-feed determination that there is no multiple feed (NO to step S157), the finisher control section 501 conveys the insert sheet to the processing tray 630 (step S158). The CPU circuit section 150 of the image forming apparatus main unit 10 determines whether or not the sheet is the final one of the sheet bundle (step S159). If the sheet is not the final one of the sheet bundle (NO to step S159), the present process returns to the step S152 so as to control the following sheet feed. If the sheet is the final one of the sheet bundle (YES to step S159), the finisher control section 501 discharges onto the stack tray 700 the bundle of the sheets stacked on the processing tray 630 (step S160). At this time, it is also possible to discharge the sheet bundle after stapling the sheet bundle discharged onto the processing tray 630 using the stapler 601.

Thereafter, the image forming apparatus main unit 10 determines whether or not discharge of a final sheet bundle is completed (step S161). If the discharge of the final sheet bundle is not completed (NO to step S161), the present process returns to the step S152, whereas if the discharge of the final sheet bundle is completed (YES to step S161), the present process is terminated.

Next, a description will be given of processing executed when it is judged in the step S157 that multiple feed of insert sheets has occurred. First, the finisher control section 501 executes a multi-fed sheet number-determining process for determining how many insert sheets have been fed in an overlapping manner (multi-fed) (step S162). How the number of multi-fed sheets is determined will be briefly described. Let it be assumed that out of the three insert sheets for the second page, the third page, and the sixth-page sheets in the above example, the insert sheet for the second page undergoes multiple feed. Now, if the sheet thickness X2 of the insert sheet for the second page satisfies the following inequality (2):

$$d2+\beta\cdot d3<X2<d2+d3+\beta\cdot d6 \tag{2}$$

wherein β is set to be equal to 0.5, it is possible to judge that multiple feed (double feed in this case) of the second and third insert sheets has occurred.

In general, when one set of n insert sheets is placed on the tray 901 of the inserter 900, whether multiple feed of t insert sheets has occurred concerning an m-th insert sheet can be determined using the following inequality (3):

$$dm+d(m+1)+\ldots+\beta d(m+t-1)<Xm<dm+d(m+1)+\ldots+\beta d(m+t) \tag{3}$$

By thus utilizing the reference values of the sheet thickness data stored in the RAM 1513 of the CPU circuit section 150 of the image forming apparatus main unit 10, it is possible to determine the number of multi-fed sheets.

In the above example, if it is judged from the multi-fed sheet number determination that the double feed, i.e. simultaneous feed of the two insert sheets for the second and third pages has occurred, similarly to the transfer sheet before occurrence of the multiple feed, the multi-fed insert sheets are discharged onto the processing tray 630 (step S163). Then, idle feed processing is executed for feeding the remaining undesired insert sheets (step S164). Now, the idle feed processing will be briefly explained. After the discharge of the multi-fed insert sheets for the second and third pages, the insert sheet for the sixth page to be inserted into the same sheet bundle is also discharged onto the processing tray 630. In short, when multiple feed occurs in an n-th set of insert sheets, the insert sheets of the n-th set are all discharged onto the processing tray 630 so as to allow feed of the first sheet of an (n+1)-th set. By executing this processing, it is possible to insert an insert sheet as the top page of the next sheet bundle. During execution of this processing, the formation of an image on a transfer sheet is suspended.

Figure 16A:
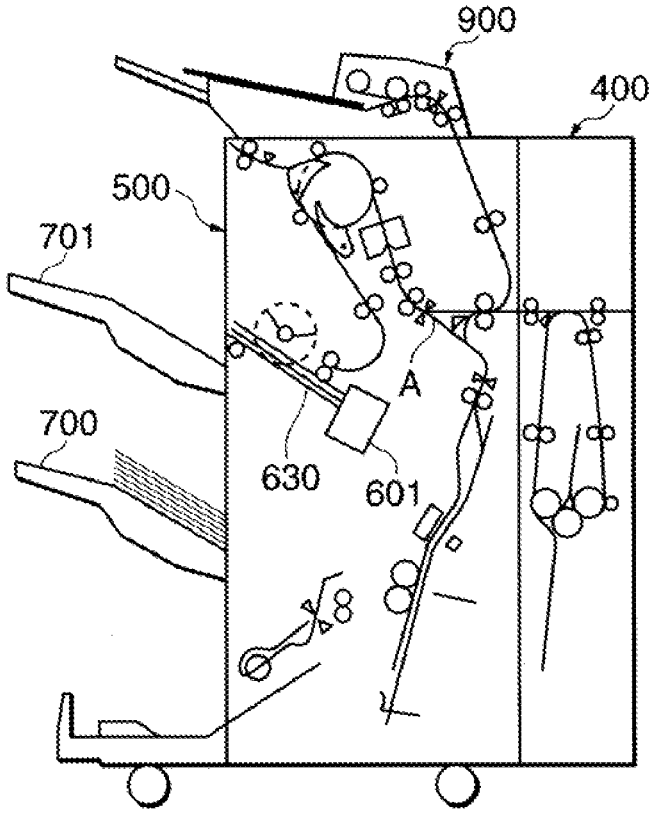

Then, when the multi-fed sheets in the step S163 and the undesired insert sheets in the step S164 are discharged onto the processing tray 630, as shown in FIG. 16A, the stack tray 700 and the sample tray 701 are lowered by a motor, not shown, until the sample tray 701 reaches a position where it can receive a sheet bundle discharged from the processing tray 630. The multi-fed sheets and the idle-fed undesired insert sheets are discharged from the processing tray 630 onto the sample tray 701 (step S165). Even if the post-processing mode including the staple processing has been selected in this case, the double-fed sheets and the undesired insert sheets are discharged onto the sample tray 701 without being subjected to the post-processing (including the staple processing). It should be noted that the sheet bundle being prepared is discharged onto the sample tray 701 together with the double-fed sheets and the idle-fed undesired insert sheets.

Figure 16B:
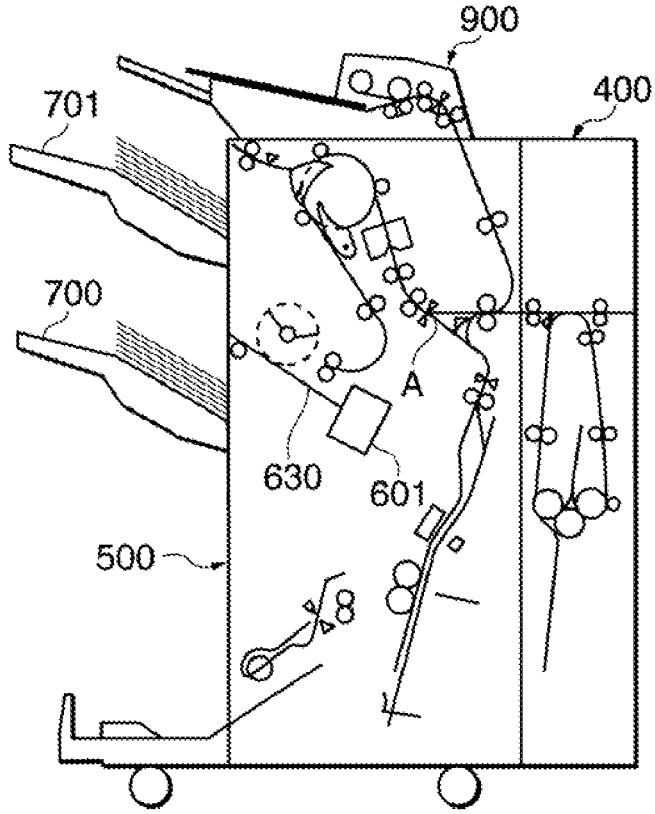

Then, when the stack tray 700 and the sample tray 701 are lifted, and as shown in FIG. 16B, the stack tray 700 returns to a position where it can receive a sheet bundle discharged from the processing tray 630, feed of insert sheets and transfer sheets is resumed, with a leading page fed first, so as to prepare a new sheet bundle (step S152). In the above example, the leading page is a transfer sheet, and therefore the operation starts with the formation of an image on a first page.

As described above, according to the first embodiment, when the image forming apparatus is provided with a plurality of discharge trays, even if multiple feed of insert sheets occurs, it is possible to stack a normally prepared sheet bundle and a sheet bundle which was not normally prepared due to the multiple feed, separately onto respective discharge trays completely apart from each other, which facilitates recognition of multi-fed insert sheets. Further, this recognition of multi-fed insert sheets makes it possible to reuse the expensive insert sheets made undesired due to the multiple feed. Furthermore, even when multiple feed of insert sheets occurs, proper recovery processing is automatically executed, so that the user need not carry out the recovery processing, which makes it possible to provide an image forming apparatus having enhanced usability.

Now, an image forming apparatus according to a second embodiment of the present invention will be described. The image forming apparatus according to the present embodiment is the same as that according to the first embodiment in its internal construction (shown in FIG. 1), the arrangement of a controller of the image forming apparatus (shown in FIG. 2), the internal construction of a finisher (shown in FIG. 3), the arrangement of a finisher control section (shown in FIG. 4), and examples of screens displayed on an operating section of the image forming apparatus (shown in FIG. 5), and therefore description thereof is omitted.

Figure 18:
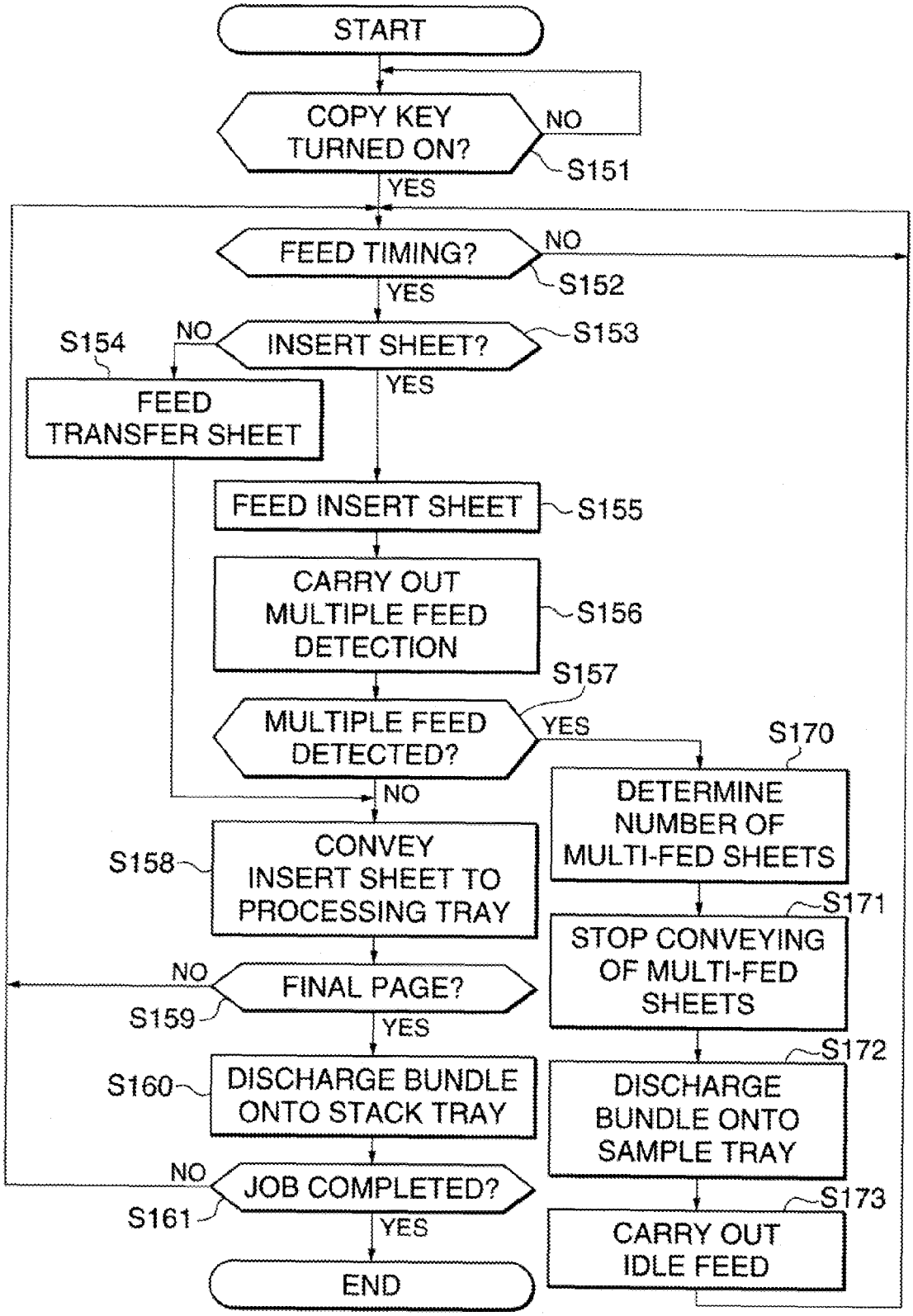
FIG. 18 is a flowchart of an inserter process executed by the image forming apparatus according to the second embodiment.

Next, an inserter process executed in the interleaved sheet mode by the image forming apparatus according to the second embodiment will be described with reference to a flowchart shown in FIG. 18. A part of the process executed from a step S151 to a step S161 in the second embodiment when no multiple feed is detected is the same as the corresponding part in the first embodiment, and therefore description thereof is also omitted.

A description will now be given of processing executed when multiple feed of insert sheets is detected in a step S157.

First, the finisher control section 501 performs the multi-fed sheet number-determining process for determining the number of multi-fed insert sheets (step S170). Then, the transfer of insert sheets being multi-fed and conveyed in a conveying path upstream of a switching flapper 510 that switches between a path leading to a sample tray 701 and a path leading to a processing tray 630 is temporarily stopped (step S171).

Figure 17A:
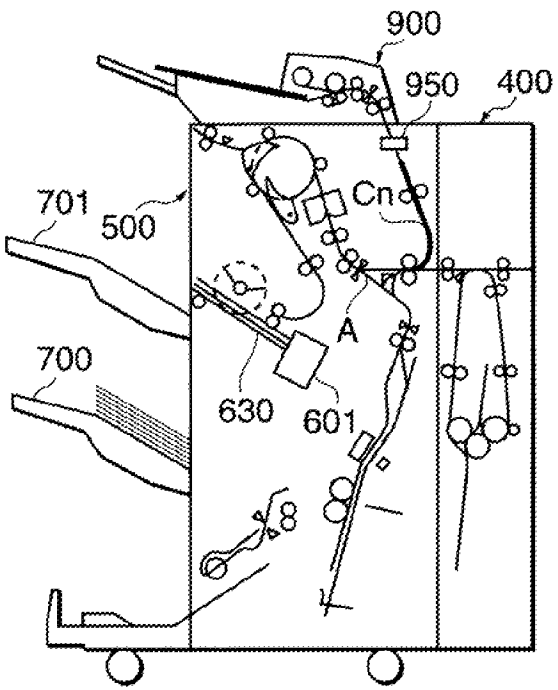
Figure 17B:
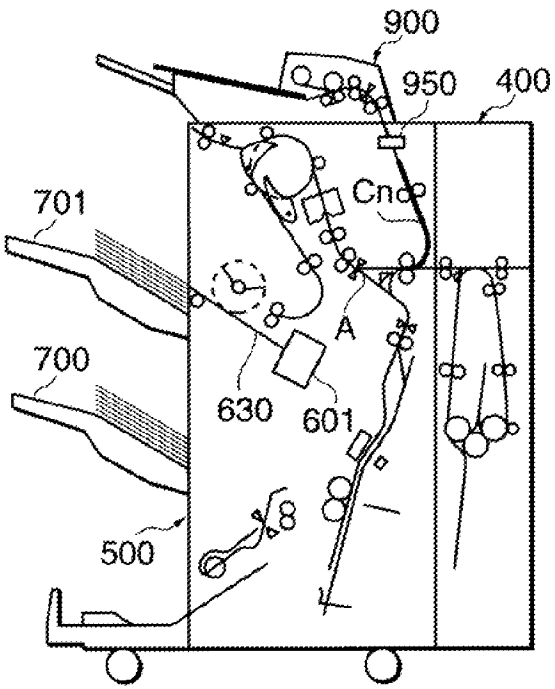

Thereafter, as shown in FIG. 17A, a stack tray 700 and the sample tray 701 are lowered by a motor, not shown, until the sample tray 701 reaches a position where it can receive a sheet bundle discharged from the processing tray 630. Then, as shown in FIG. 17B, a sheet bundle being prepared and already discharged onto the processing tray 630 is discharged in a bundled state onto the sample tray 701 (step S172).

Figure 17C:
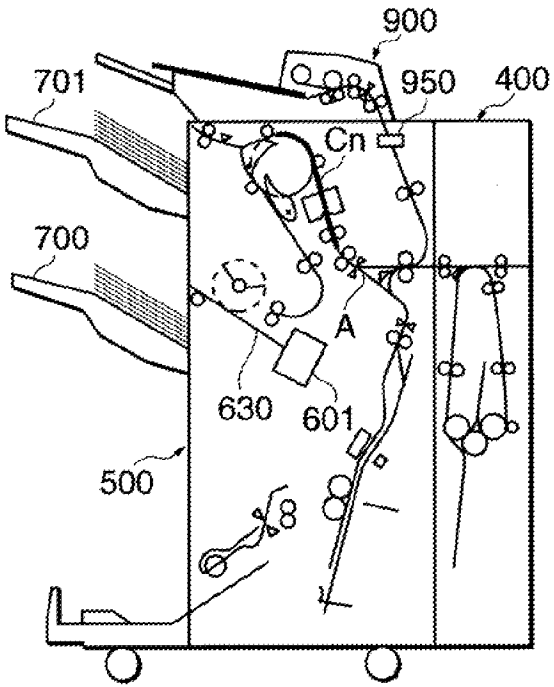

Then, as shown in FIG. 17C, the stack tray 700 and the sample tray 701 are lifted to be returned to respective positions where the stack tray 700 can receive a sheet bundle discharged from the processing tray 630 and the sample tray 701 can receive a sheet bundle discharged through the non-sort path 521. During this operation, the formation of an image on a transfer sheet is suspended. Further, the multi-fed insert sheets are temporarily stopped in the conveying path.

Then, the transfer of the multi-fed insert sheets temporarily stopped in the conveying path is resumed, and the multi-fed insert sheets are discharged onto the sample tray 701 via the non-sort path 521. Then, idle feed processing of insert sheets is executed (step S173). In this idle feed processing for setting the next insert sheet to the leading page of the next sheet bundle, as is distinct from the first embodiment, insert sheets to be inserted into the same sheet bundle into which the multi-fed insert sheets should have been inserted are discharged through the non-sort path 521 onto the sample tray 701.

Thereafter, when the stack tray 700 returns to the position where it can receive a sheet bundle discharged from the processing tray 630, the feed of insert sheets and transfer sheets is resumed, with the insert sheet for the leading page fed first, so as to prepare a new sheet bundle (step S152).

As described above, according to the second embodiment, the same advantageous effects as provided by the first embodiment can be obtained.

Although in the first and second embodiments, when multiple feed of insert sheets occurs in the image forming apparatus, a normally prepared sheet bundle and a sheet bundle which was not normally prepared due to the multiple feed are separately stacked on respective discharge trays completely apart from each other, it is also possible to inform the user of occurrence of multiple feed by displaying a message or the like in the operating section of the image forming apparatus, or causing an LED to blink.

Further, although in the first and second embodiments, a sheet bundle is prepared by inserting insert sheets fed from the inserter 900 into sheets having images formed thereon by the main unit of the image forming apparatus, the present invention may also be applied to non-paper media, such as OHP media and the like.

In the first and second embodiments, the present invention is applied to an image forming apparatus (copying machine) equipped with an image reading function and an image forming function, but the present invention is also applicable to an image forming apparatus (multi-function machine) equipped with an image reading function, an image forming function, and an facsimile function.

Furthermore, the present invention may be applied to a system comprised of a plurality of apparatuses or to an apparatus formed by a single apparatus. It also goes without saying that the object of the present invention may be accomplished by supplying a system or apparatus with a storage medium storing a program code of software realizing the functions of either of the above described embodiments, and causing a computer (CPU or MPU) of the system or apparatus to read out and execute the program stored in the storage medium.

In this case, the program code itself read from the storage medium realizes the functions of either of the above described embodiments, and hence the storage medium on which the program code is stored constitutes the present invention. Examples of the storage medium for supplying the program code include a floppy (registered trademark) disk, a hard disk, an optical disk, a magnetic-optical disk, a CD-ROM, a CD-R, a CD-RW, a DVD-ROM, a DVD-RAM, a DVD–RW, a DVD+RW, a magnetic tape, a nonvolatile memory card, and a ROM. Downloading via a network can also be utilized.

Further, it is to be understood that the functions of either of the above described embodiments may be accomplished not only by executing a program code read out by a computer, but also by causing an OS (operating system) or the like which operates on the computer to perform a part or all of the actual operations based on instructions of the program code.

Further, it is to be understood that the functions of either of the above described embodiments may be accomplished by writing a program code read out from the storage medium into a memory provided on an expansion board inserted into a computer or in an expansion unit connected to the computer and then causing a CPU or the like provided in the expansion board or the expansion unit to perform a part or all of the actual operations based on instructions of the program code.

What is claimed is:

1. A sheet conveying apparatus comprising:

a conveyor device that conveys sheets;

a stacking device in which the sheets conveyed by said conveyor device are stacked;

a discharge device that discharges a bundle of the sheets stacked in said stacking device;

a first receiving device that receives a bundle of the sheets discharged by said discharge device;

a second receiving device that receives a bundle of the sheets discharged by said discharge device;

a determining device that determines whether there is abnormality in conveyance of sheets to said stacking device;

a controller that causes the bundle of the sheets stacked in said stacking device to be discharged onto said first receiving device in a case where said determining device determines that there is no abnormality in the conveyance of sheets to said stacking device, and causes the bundle of the sheets stacked in said stacking device to be discharged onto said second receiving device in a case where said determining device determines that there is abnormality in the conveyance of sheets to said stacking device; and a stapler that staples the bundle of sheets stacked in said stacking device, wherein the bundle of the sheets stacked in said stacking device to be discharged onto said second receiving device includes both at least one sheet for which abnormality has been determined and at least one sheet for which no abnormality has been determined.

2. A sheet conveying apparatus according to claim 1, wherein said determining device comprises a detector that detects whether sheets are being conveyed by said conveyor while overlapping each other, and said determining device determines, based on a result of the detection by said detector, whether there is abnormality in the conveyance of sheets to said stacking device.

3. A sheet conveying apparatus according to claim 2, wherein said detector detects thickness of sheets being conveyed in said conveyor device, to thereby detect whether sheets are being conveyed while overlapping each other.

4. A sheet conveying apparatus according to claim 1, further comprising:

a second stacking device in which sheets to be fed to said stacking device are stacked; and a feeder that feeds the sheets stacked in said second stacking device, wherein said conveyor device conveys the sheets fed by said feeder to said stacking device.

5. A sheet conveying apparatus according to claim 1, wherein said controller controls said stapler so that the bundle of sheets to be discharged to said second receiving device from said stacking device is not stapled when said determining device determines that there is abnormality in conveyance of sheets to said stacking device.

* * * * *